US011084287B2

(12) United States Patent
Kida et al.

(10) Patent No.: US 11,084,287 B2
(45) Date of Patent: Aug. 10, 2021

(54) PRINTING APPARATUS, CONTROL METHOD THEREOF AND STORAGE MEDIUM

(71) Applicant: CANON KABUSHIKI KAISHA, Tokyo (JP)

(72) Inventors: Akira Kida, Yokohama (JP); Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 16/534,148

(22) Filed: Aug. 7, 2019

(65) Prior Publication Data

US 2020/0047505 A1 Feb. 13, 2020

(30) Foreign Application Priority Data

Aug. 10, 2018 (JP) ..... JP2018-151633

(51) Int. Cl.
*B41J 2/165* (2006.01)
*B41J 2/17* (2006.01)

(52) U.S. Cl.
CPC ..... *B41J 2/16505* (2013.01); *B41J 2/1714* (2013.01)

(58) Field of Classification Search
CPC ... B41J 2/16505; B41J 2/1714; B41J 11/0085
USPC ..... 347/29, 30, 101, 102, 104
See application file for complete search history.

(56) References Cited

U.S. PATENT DOCUMENTS 7,497,545 B2 * 3/2009 Shimizu ..... B41J 2/16585 347/104
8,104,888 B2 * 1/2012 Sugimoto ..... B41J 2/16585 347/104
8,523,348 B2 * 9/2013 Yamamoto ..... B65H 5/26 347/104
8,807,732 B2 * 8/2014 Onozawa ..... B41J 11/002 347/102

FOREIGN PATENT DOCUMENTS

JP 2005161758 A 6/2005
JP 2017077636 A 4/2017

* cited by examiner

*Primary Examiner* — An H Do
(74) *Attorney, Agent, or Firm* — Venable LLP

(57) ABSTRACT

An object is to remove paper powder from a conveyance path while preventing the paper powder floating in the conveyance path from sticking to an ejection port. The present disclosure is printing apparatus having: a conveyance unit configured to convey a printing medium; a print head having an ejection unit configured to eject a liquid to the printing medium and performing a printing operation; a blower unit configured to blow air from a downstream toward the printing area in the conveyance path during the printing operation; and a cap member switchable between a cap-closed state and a cap-open state, and after the printing operation terminates, the blower unit stops to blow air and the blower unit resumes to blow air after the cap member switches from the cap-open state into the cap-closed state.

17 Claims, 19 Drawing Sheets

PRINTING APPARATUS, CONTROL METHOD THEREOF AND STORAGE MEDIUM

BACKGROUND OF THE INVENTION

Field of the Invention

The present disclosure relates to a printing apparatus, a control method, and a storage medium.

Description of the Related Art

Japanese Patent Laid-Open No. 2017-77636 has disclosed a printing apparatus including a line head.

SUMMARY OF THE INVENTION

It is possible for the printing apparatus described in Japanese Patent Laid-Open No. 2017-77636 to perform high-speed printing by a line head and during the printing operation, a printing medium is conveyed at a high speed within the apparatus. Consequently, a flow of air (called conveyance airflow) advancing from the upstream side to the downstream side along the conveyance path of the printing medium is likely to occur.

In a case where paper powder of a printing medium, which occurs accompanying the conveyance of the printing medium and floats in the conveyance path, sticks to the ejection port of ink due to the conveyance airflow, there is a possibility that an ejection failure of the ejection port is caused. Further, in a case where the paper powder sticks to and accumulates in the conveyance path of the printing medium by the conveyance airflow, there is a possibility that trouble is caused, such as abnormal conveyance of the printing medium and a reduction in the detection accuracy of a sensor provided in the conveyance path.

Consequently, in view of the above-described problems, an object of the present disclosure is to remove paper powder from the conveyance path while preventing the paper powder floating in the conveyance path from sticking to the ejection port.

One embodiment of the present invention is a printing apparatus having: a conveyance unit configured to convey a printing medium along a conveyance path; a print head having an ejection unit configured to eject a liquid to the printing medium and performing a printing operation to eject the liquid from the ejection unit in a printing area including a part of the conveyance path; a blower unit configured to blow air from a downstream of the printing area toward the printing area in the conveyance path during the printing operation; and a cap member switchable between a cap-closed state where an ejection port surface of the ejection unit is capped and a cap-open state where the ejection port surface is not capped, and after the printing operation terminates, the blower unit stops to blow air and the blower unit resumes to blow air after the cap member switches from the cap-open state into the cap-closed state.

Further features of the present invention will become apparent from the following description of exemplary embodiments with reference to the attached drawings.

DESCRIPTION OF THE EMBODIMENTS

In the following, embodiments of the present disclosure are explained with reference to the drawings. The following embodiments are not intended to limit the present disclosure and all combinations of features explained in the present embodiments are not necessarily indispensable to the solution of the present disclosure. The same configuration is explained by attaching the same symbol. Further, the relative arrangement, the shapes, and the like of the components described in the embodiments are merely exemplary and are not intended to limit the scope of this disclosure only to those.

First Embodiment

Figure 1:
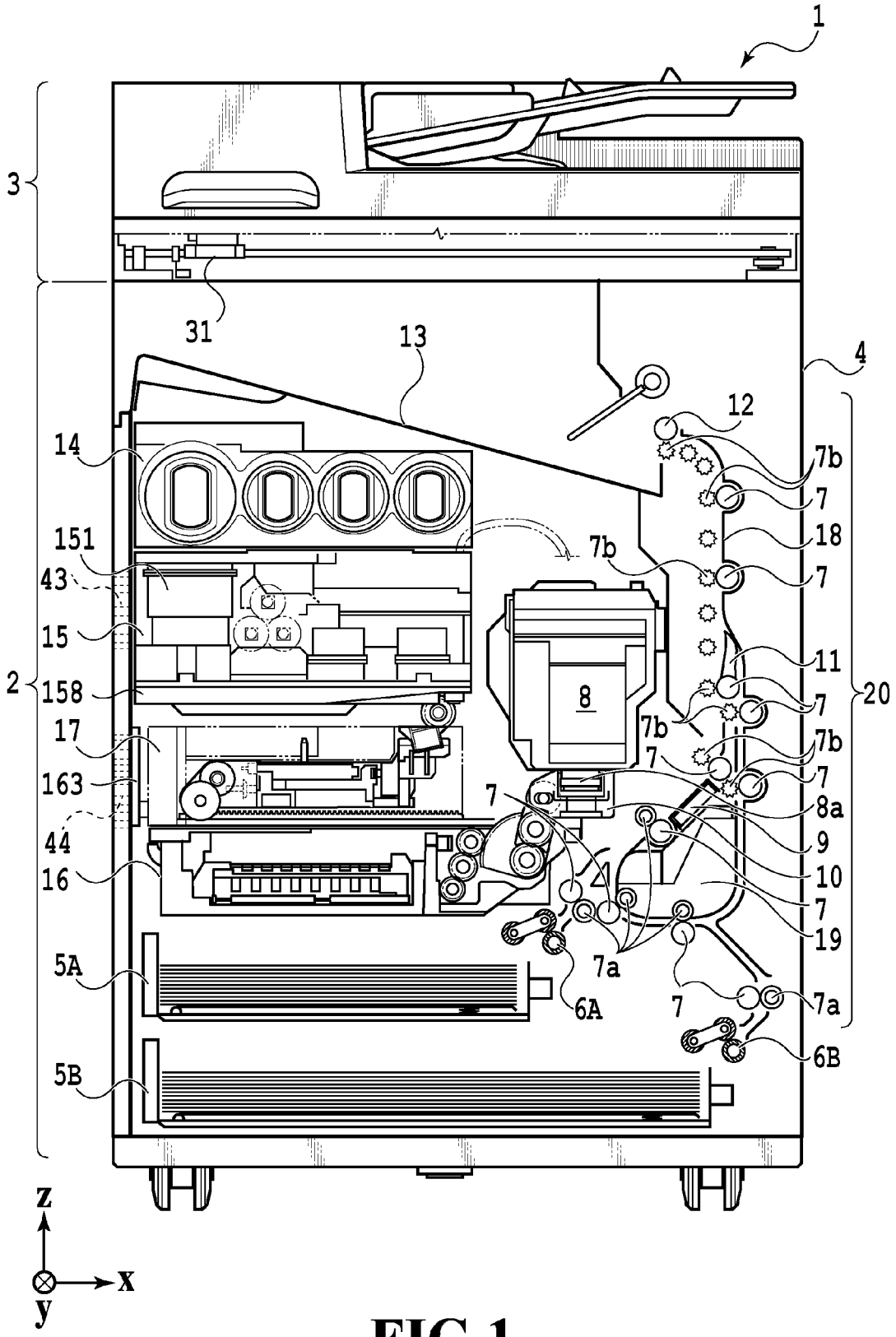
FIG. 1 is a diagram in a case where a printing apparatus is in a standby state.

FIG. 1 is an internal configuration diagram of an ink jet printing apparatus 1 (hereinafter, referred to as printing apparatus 1) used in the present embodiment. In FIG. 1, the x-direction indicates the horizontal direction, the y-direction (direction perpendicular to the paper surface) indicates the direction in which ejection ports are arrayed in a print head 8, to be described later, and the z-direction indicates the vertical direction (direction of force of gravity), respectively.

The printing apparatus 1 is an MFP (Multi Function Printer) including a print unit 2 and a scanner unit 3 and capable of performing various pieces of processing relating to the printing operation and the reading operation by the print unit 2 and the scanner unit 3 individually, or in an interlocking manner of the print unit 2 and the scanner unit 3. The scanner unit 3 includes an ADF (Auto Document Feeder) and an FBS (Flat Bed Scanner) and is capable of reading of a document automatically fed by the ADF and reading (scanning) of a document placed on a document table of the FBS by a user. The scanner unit 3 is configured so as to be removable alone from the printing apparatus main body. In this specification, being configured so as to be removable alone refers to being removable without affecting other mechanisms (units). That is, in a case where a user removes the scanner unit 3, it is possible to remove the scanner unit 3 without the need to remove other mechanisms. The scanner unit 3 is configured so as to be detachable from the ceiling surface of the apparatus in a slide manner. The present embodiment is an MFP having both the print unit 2 and the scanner unit 3, but the present embodiment may also be an aspect in which the scanner unit 3 is not included. FIG. 1 shows a case where the printing apparatus 1 is in a standby state where the printing apparatus 1 is performing neither printing operation nor reading operation.

In the print unit 2, at the bottom in the vertically downward direction (direction of force of gravity) of a casing 4, a first cassette 5A and a second cassette 5B for storing a printing medium (cut sheet) S are installed detachably. In the first cassette 5A, comparatively small printing media up to the A4 size, and in the second cassette 5B, comparatively large printing media up to the A3 size are stored in a piled-up manner. In the vicinity of the first cassette 5A, a first feed unit 6A for feeding stored printing media by separating one by one is provided. Similarly, in the vicinity of the second cassette 5B, a second feed unit 6B is provided. In a case where the printing operation is performed, the printing medium S is selectively fed from one of the cassettes.

A conveyance roller 7, a discharge roller 12, a pinch roller 7*a*, a spur 7*b*, a guide 18, an inner guide 19, and a flapper 11 are a conveyance unit 20 configured to guide the printing medium S in a predetermined direction. The conveyance unit 20 is configured so as to be removable alone from the printing apparatus main body. The conveyance roller 7 is arranged on the upstream side and on the downstream side of the print head 8 and is a drive roller that is driven by a conveyance motor, not shown schematically. The pinch roller 7*a* is a follower roller that nips and rotates the printing medium S together with the conveyance roller 7. The discharge roller 12 is arranged on the downstream side of the conveyance roller 7 and is a drive roller that is driven by a conveyance roller, not shown schematically. The spur 7*b* sandwiches and conveys the printing medium S together with the conveyance roller 7 arranged on the downstream side of the print head 8 and the discharge roller 12.

The guide 18 is provided in the conveyance path of the printing medium S and guides the printing medium S in a predetermined direction. The inner guide 19 is a member extending in the y-direction and has a curved side surface, and guides the printing medium S along the side surface. The flapper 11 is a member for switching directions in which the printing medium S is conveyed at the time of the both-side printing operation. A discharge tray 13 is a tray for loading and holding the printing medium S for which the printing operation has been completed and which is discharged by the discharge roller 12.

The print head 8 of the present embodiment is a color ink jet print head of full line type and in which a plurality of ejection ports from which ink is ejected in accordance with print data is arrayed along the y-direction in FIG. 1 so as to correspond to the width of the printing medium S. That is, the print head 8 is configured so as to be capable of ejecting inks of a plurality of colors. In a case where the print head 8 is at the standby position, an ejection port surface 8*a* of the print head 8 faces in the vertically downward direction and is capped by a cap unit 10 as in FIG. 1. In a case where the printing operation is performed, by a print controller 202, to be described later, the orientation of the print head 8 is changed so that the ejection port surface 8*a* faces a platen 9. The platen 9 is made up of a flat plate extending in the y-direction and supports the printing medium S from the rear side, for which the printing operation is performed by the print head 8. The movement of the print head 8 from the standby position to the printing position will be described later in detail. The print head 8 is configured so as to be removable alone from the printing apparatus main body.

An ink tank unit 14 stores four color inks to be supplied to the print head 8, respectively. An ink supply unit 15 is provided on the way in the flow path connecting the ink tank unit 14 and the print head 8 and adjusts the pressure and the flow rate of the ink within the print head 8 to an appropriate range. In the present embodiment, a circulation-type ink supply system is adopted and the ink supply unit 15 adjusts the pressure of the ink supplied to the print head 8 and the flow rate of the ink recovered from the print head 8 to an appropriate range. The ink tank unit 14 and the ink supply unit 15 are respectively configured so as to be removable alone from the printing apparatus main body.

A maintenance unit 16 includes the cap unit 10 and a wiping unit 17 and performs the maintenance operation for the print head 8 by causing these units to operate at predetermined timing. The maintenance unit 16 is configured so as to be removable alone from the printing apparatus main body.

Figure 2:
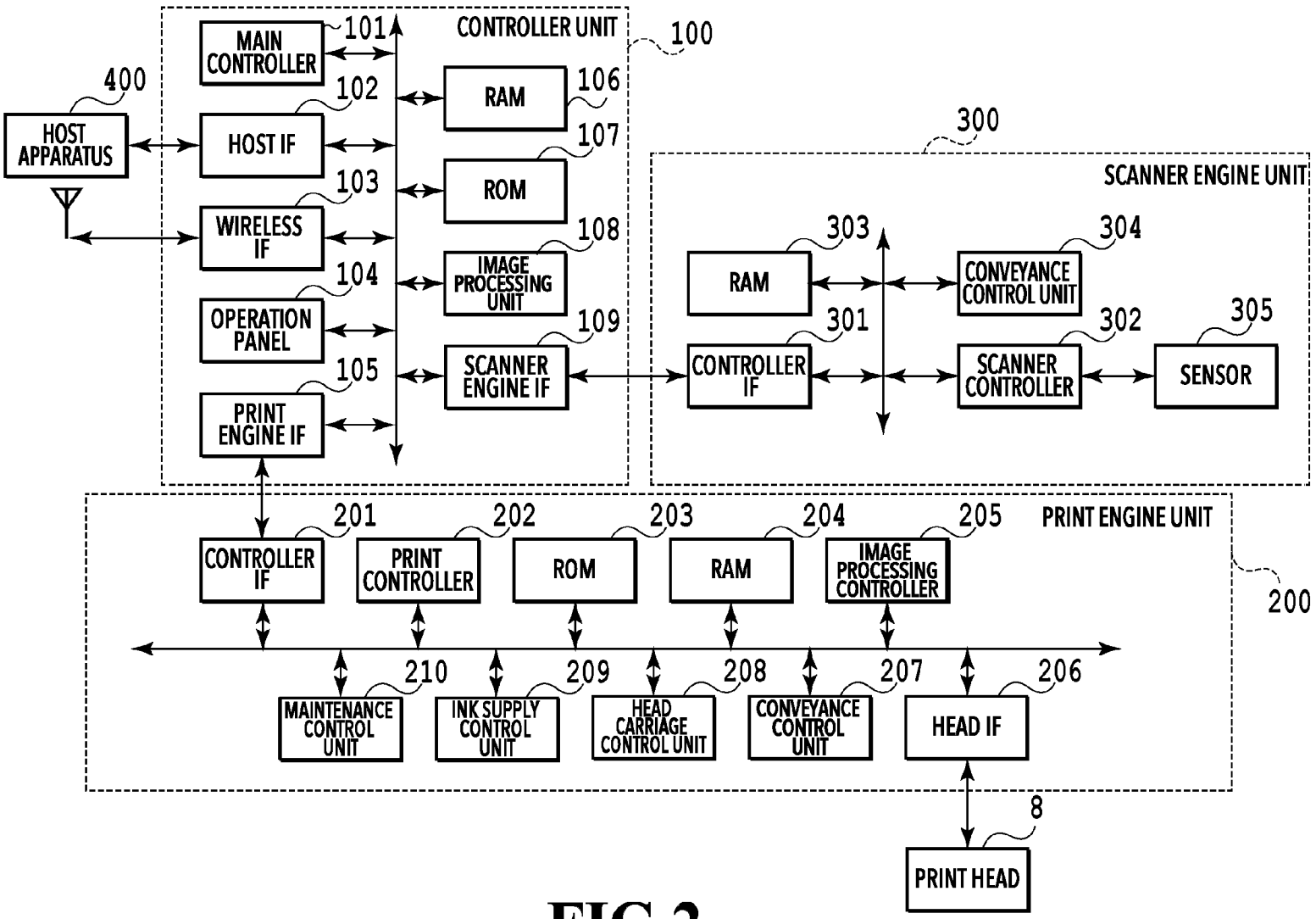
FIG. 2 is a control configuration diagram of the printing apparatus.

FIG. 2 is a block diagram showing a control configuration in the printing apparatus 1. The control configuration mainly includes a print engine unit 200 configured to centralizedly control the print unit 2, a scanner engine unit 300 configured to centralizedly control the scanner unit 3, and a controller unit 100 configured to centralizedly control the entire printing apparatus 1. The print controller 202 controls various mechanisms of the print engine unit 200 in accordance with instructions of a main controller 101 of the controller unit 100. Various mechanisms of the scanner engine unit 300 are controlled by the main controller 101 of the controller unit 100. In the following, details of the control configuration are explained.

In the controller unit 100, the main controller 101 including a CPU controls the entire printing apparatus 1 by using a RAM 106 as a work area in accordance with programs and various parameters stored in a ROM 107. For example, in a case where a print job is input from a host apparatus 400 via a host I/F 102 or a wireless I/F 103, predetermined image processing is performed for image data received by an image processing unit 108 in accordance with instructions of the main controller 101. Then, the main controller 101 transmits the image data for which the image processing has been performed to the print engine unit 200 via a print engine I/F 105.

The printing apparatus 1 may acquire image data from the host apparatus 400 via wireless communication or wired communication, or may acquire image data from an external storage device (USB memory and the like) connected to the printing apparatus 1. The communication method that is made use of for wireless communication or wired communication is not limited. For example, as the communication method that is made use of for wireless communication, it is possible to apply Wi-Fi (Wireless Fidelity) (registered trademark) and Bluetooth (registered trademark). Further, as the communication method that is made use of for wired communication, it is possible to apply USB (Universal Serial Bus) and the like. Furthermore, for example, in a case where a reading command is input from the host apparatus 400, the main controller 101 transmits this command to the scanner unit 3 via a scanner engine I/F 109.

An operation panel 104 is a mechanism for a user to input and output for the printing apparatus 1. It is possible for a user to give instructions to perform an operation, such as a copy operation and a scan operation, to set a printing mode, to recognize information on the printing apparatus 1, and so on, via the operation panel 104.

In the print engine unit 200, the print controller 202 including a CPU controls various mechanisms included in the print unit 2 by using a RAM 204 as a work area in accordance with programs and various parameters stored in a ROM 203. In a case where various commands and image data are received via a controller I/F 201, the print controller 202 temporarily saves them in the RAM 204. The print controller 202 causes an image processing controller 205 to convert the saved image data into print data so that the print head 8 can make use of for the printing operation. In a case where print data is generated, the print controller 202 causes the print head 8 to perform the printing operation based on the print data via a head I/F 206. At this time, the print controller 202 conveys the printing medium S by driving the feed units 6A and 6B, the conveyance roller 7, the discharge roller 12, and the flapper 11 shown in FIG. 1 via a conveyance control unit 207. In accordance with instructions of the print controller 202, the printing operation by the print head 8 is performed in an interlocking manner with the conveyance operation of the printing medium S and thus printing processing is performed.

A head carriage control unit 208 changes the orientation and position of the print head 8 in accordance with the operating state, such as the maintenance state and the printing state, of the printing apparatus 1. An ink supply control unit 209 controls the ink supply unit 15 so that the pressure of the ink supplied to the print head 8 is adjusted within an appropriate range. A maintenance control unit 210 controls the operation of the cap unit 10 and the wiping unit 17 in the maintenance unit 16 at the time of performing the maintenance operation for the print head 8.

In the scanner engine unit 300, the main controller 101 controls hardware resources of a scanner controller 302 by using the RAM 106 as a work area in accordance with programs and various parameters stored in the ROM 107. Due to this, various mechanisms included in the scanner unit 3 are controlled. For example, by the main controller 101 controlling the hardware resources within the scanner controller 302 via a controller I/F 301, a document mounted on the ADF by a user is conveyed via a conveyance control unit 304 and read by a sensor 305. Then, the scanner controller 302 saves the read image data in a RAM 303. It is possible for the print controller 202 to cause the print head 8 to perform the printing operation based on the image data read by the scanner controller 302 by converting the image data acquired as described above into print data.

Figure 3:
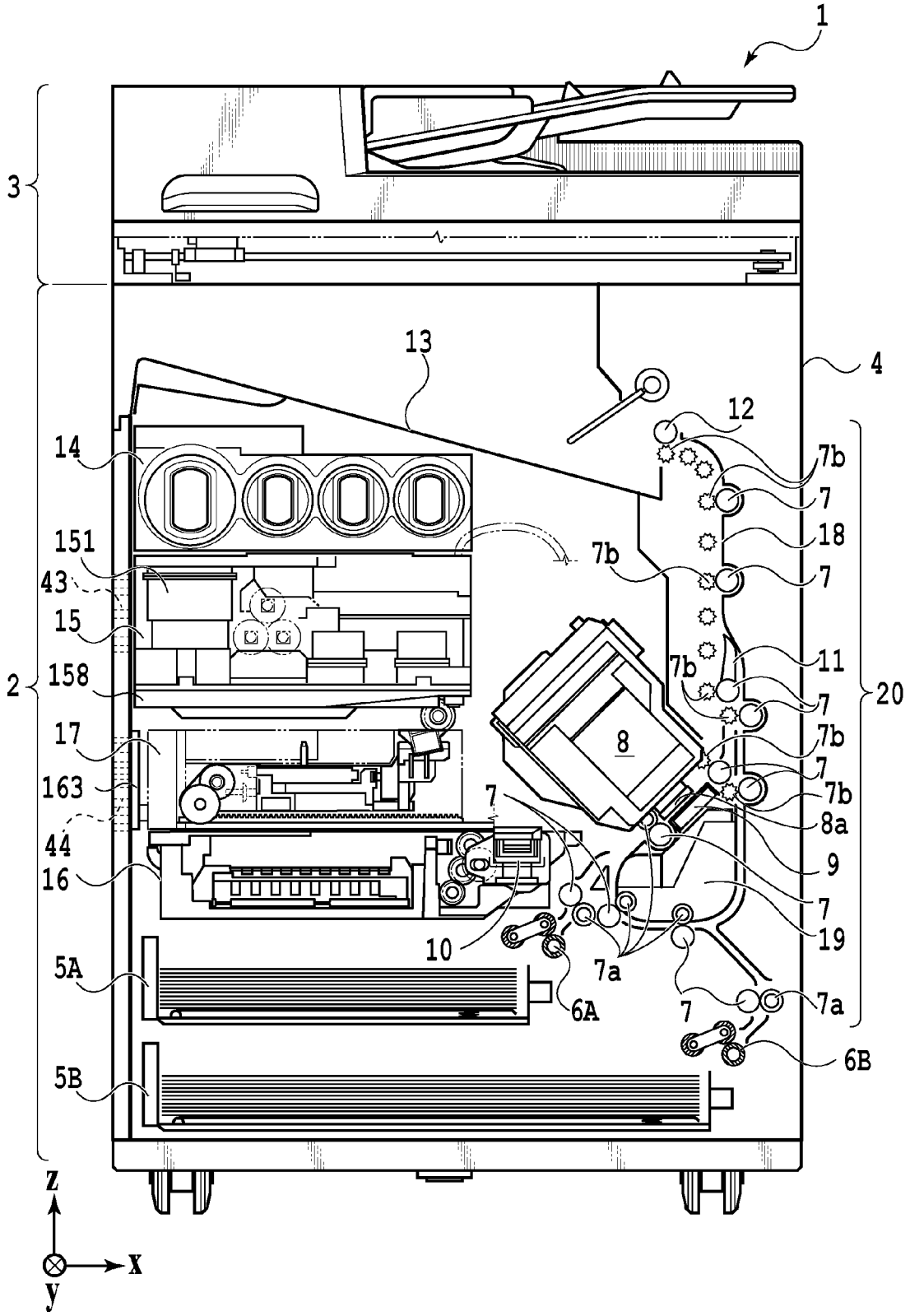
FIG. 3 is a diagram in a case where the printing apparatus is in a printing state.

FIG. 3 shows a case where the printing apparatus 1 is in the printing state. Compared to the standby state shown in FIG. 1, the cap unit 10 separates from the ejection port surface 8*a* of the print head 8 and the ejection port surface 8*a* faces the platen 9. In the present embodiment, the plane of the platen 9 is inclined about 45 degrees with respect to the horizontal direction and the ejection port surface 8*a* of the print head 8 at the printing position is also inclined about 45 degrees with respect to the horizontal direction so that the distance from the platen 9 is kept constant.

At the time of moving the print head 8 from the standby position shown in FIG. 1 to the printing position shown in FIG. 3, the print controller 202 lowers the cap unit 10 down to the evacuate position shown in FIG. 3 by using the maintenance control unit 210. Due to this, the ejection port surface 8*a* of the print head 8 separates from a cap member 10*a*. After this, the print controller 202 rotates the print head 8 by 45 degrees while adjusting the height in the vertical direction of the print head 8 by using the head carriage control unit 208 and causes the ejection port surface 8*a* to face the platen 9. In a case where the printing operation is completed and the print head 8 moves from the printing position to the standby position, the process opposite to that described above is performed by the print controller 202.

Figure 4C:
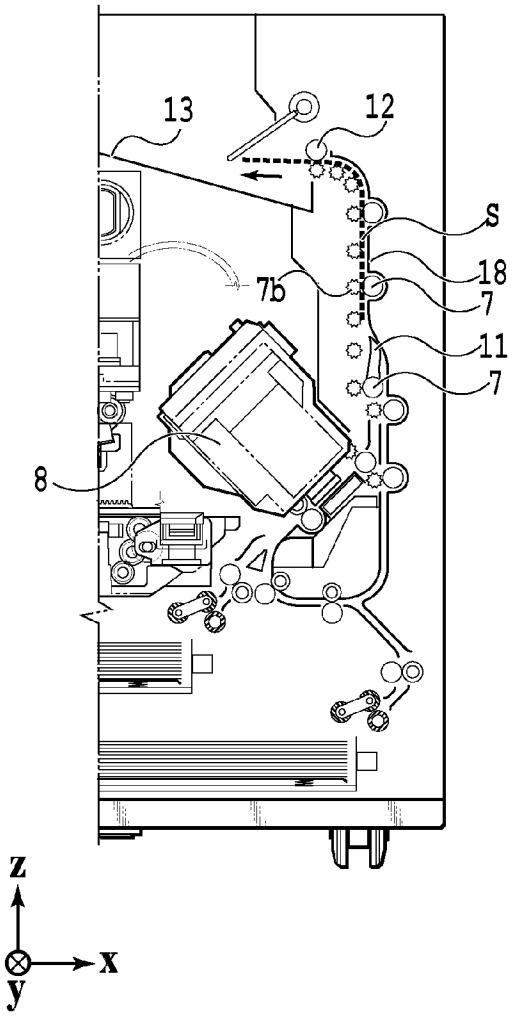
FIG. 4A to FIG. 4C are each a diagram showing a conveyance path of a printing medium fed from a first cassette.
Figure 4B:
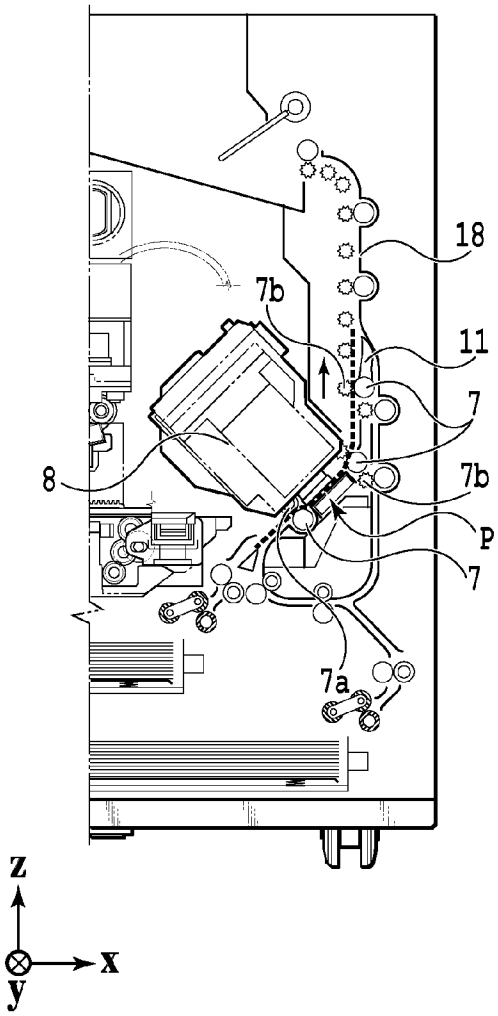
Figure 4A:
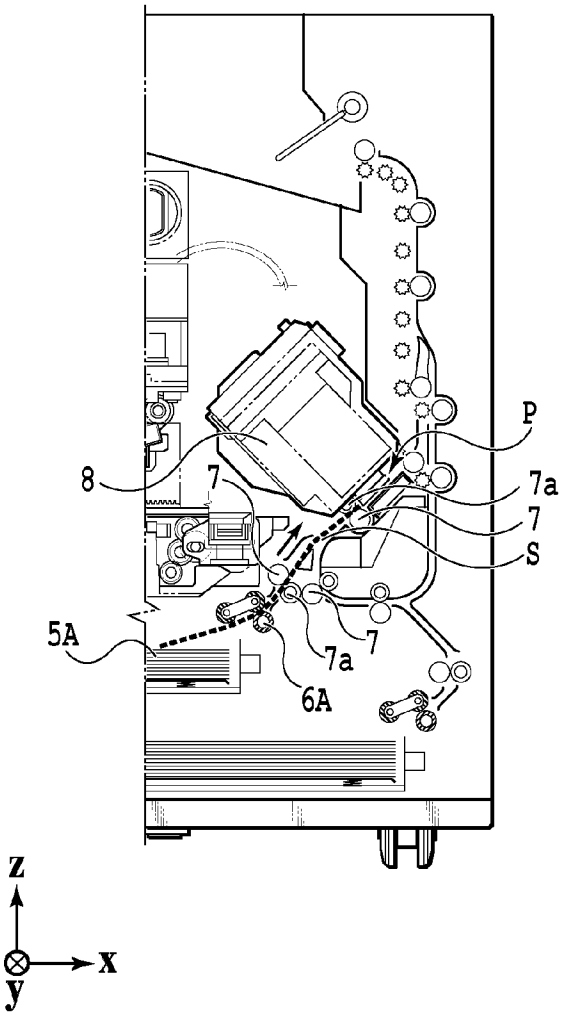

FIG. 4A to FIG. 4C are each a diagram showing a conveyance path in a case where the printing medium S of the A4 size stored in the first cassette 5A is fed. The printing medium S loaded on the top within the first cassette 5A is separated from the second and subsequent printing media by the first feed unit 6A and conveyed toward a printing area P between the platen 9 and the print head 8 while being nipped by the conveyance roller 7 and the pinch roller 7*a*. FIG. 4A shows the conveyance state immediately before the front end of the printing medium S reaches the printing area P. The advancement direction of the printing medium S is changed from the horizontal direction (x-direction) to the direction about 45 degrees inclined with respect to the horizontal direction before the printing medium S reaches the printing area P by being fed by the first feed unit 6A.

The printing area P is an area including a part of the conveyance path of a printing medium and in the printing area P, ink is ejected toward the printing medium S from a plurality of ejection ports provided in the print head 8. The printing medium S in the area where ink is given is supported by the platen 9 at its rear side and the distance between the ejection port surface 8*a* and the printing medium S is kept constant. The printing medium S after ink is given passes the left side of the flapper 11 whose front end is inclined to the right and is conveyed in the vertically upward direction of the printing apparatus 1 along the guide 18 while being guided by the conveyance roller 7 and the spur 7*b*. FIG. 4B shows the state where the front end of the printing medium S passes the printing area P and is conveyed in the vertically upward direction. The advancement direction of the printing medium S is changed from the position of the printing area P about 45 degrees inclined with respect to the horizontal direction to the vertically upward direction by the conveyance roller 7 and the spur 7*b*.

After being conveyed in the vertically upward direction, the printing medium S is discharged to the discharge tray 13 by the discharge roller 12 and the spur 7*b*. FIG. 4C shows the state where the front end of the printing medium S passes the discharge roller 12 and is discharged to the discharge tray 13. The discharged printing medium S is held on the discharge tray 13 in the state where the side on which an image is printed by the print head 8 faces downward.

Figure 5C:
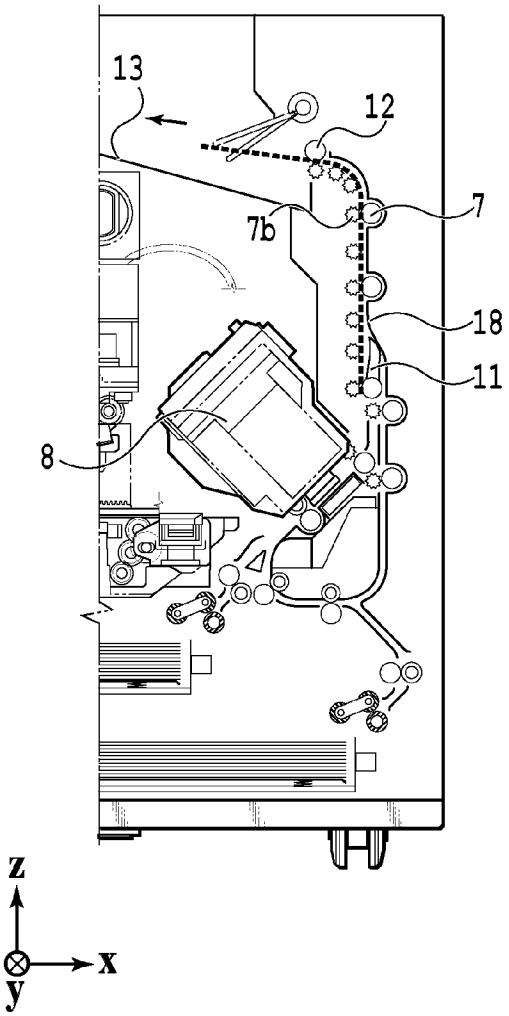
FIG. 5A to FIG. 5C are each a diagram showing a conveyance path of a printing medium fed from a second cassette.
Figure 5B:
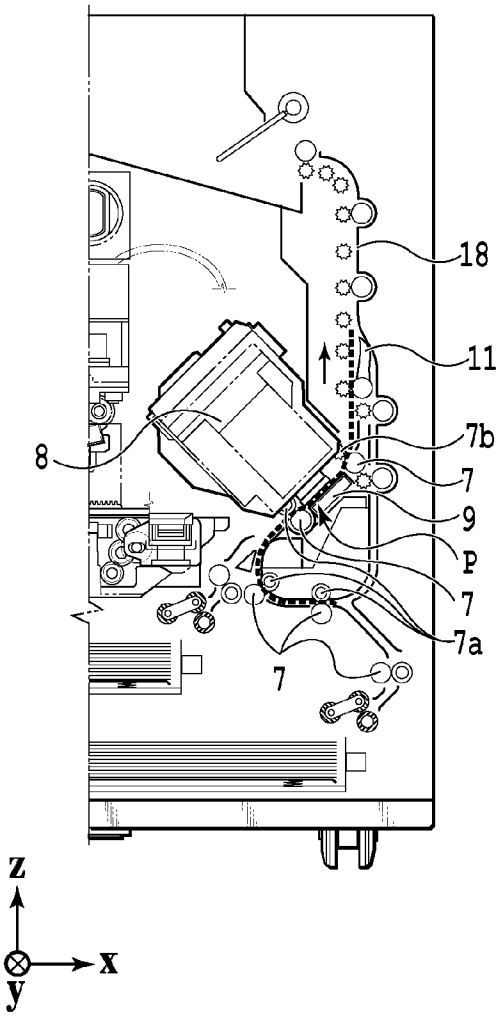
Figure 5A:
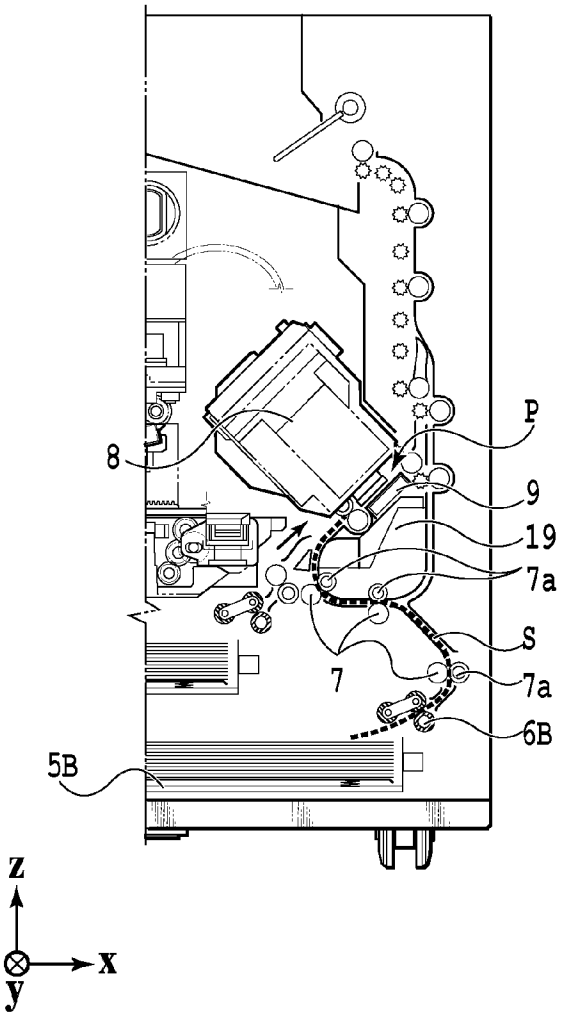

FIG. 5A to FIG. 5C are each a diagram showing a conveyance path in a case where the printing medium S of the A3 size stored in the second cassette 5B is fed. The printing medium S loaded on the top within the second cassette 5B is separated from the second and subsequent printing media by the second feed unit 6B and conveyed toward the printing area P between the platen 9 and the print head 8 while being nipped by the conveyance roller 7 and the pinch roller 7*a*.

FIG. 5A shows the conveyance state immediately before the front end of the printing medium S reaches the printing area P. In the conveyance path until the printing medium S reaches the printing area P by being fed by the second feed unit 6B, a plurality of the conveyance rollers 7, a plurality of the pinch rollers 7*a*, and the inner guide 19 are arranged, and thereby, the printing medium S is curved into an S-shape and conveyed up to the platen 9.

The conveyance path after this is the same as in the case with the printing medium S of the A4 size shown in FIG. 4B and FIG. 4C. FIG. 5B shows the state where the front end of the printing medium S passes the printing area P and is conveyed in the vertically upward direction. FIG. 5C shows the state where the front end of the printing medium S passes the discharge roller 12 and is discharged to the discharge tray 13.

Figure 6:
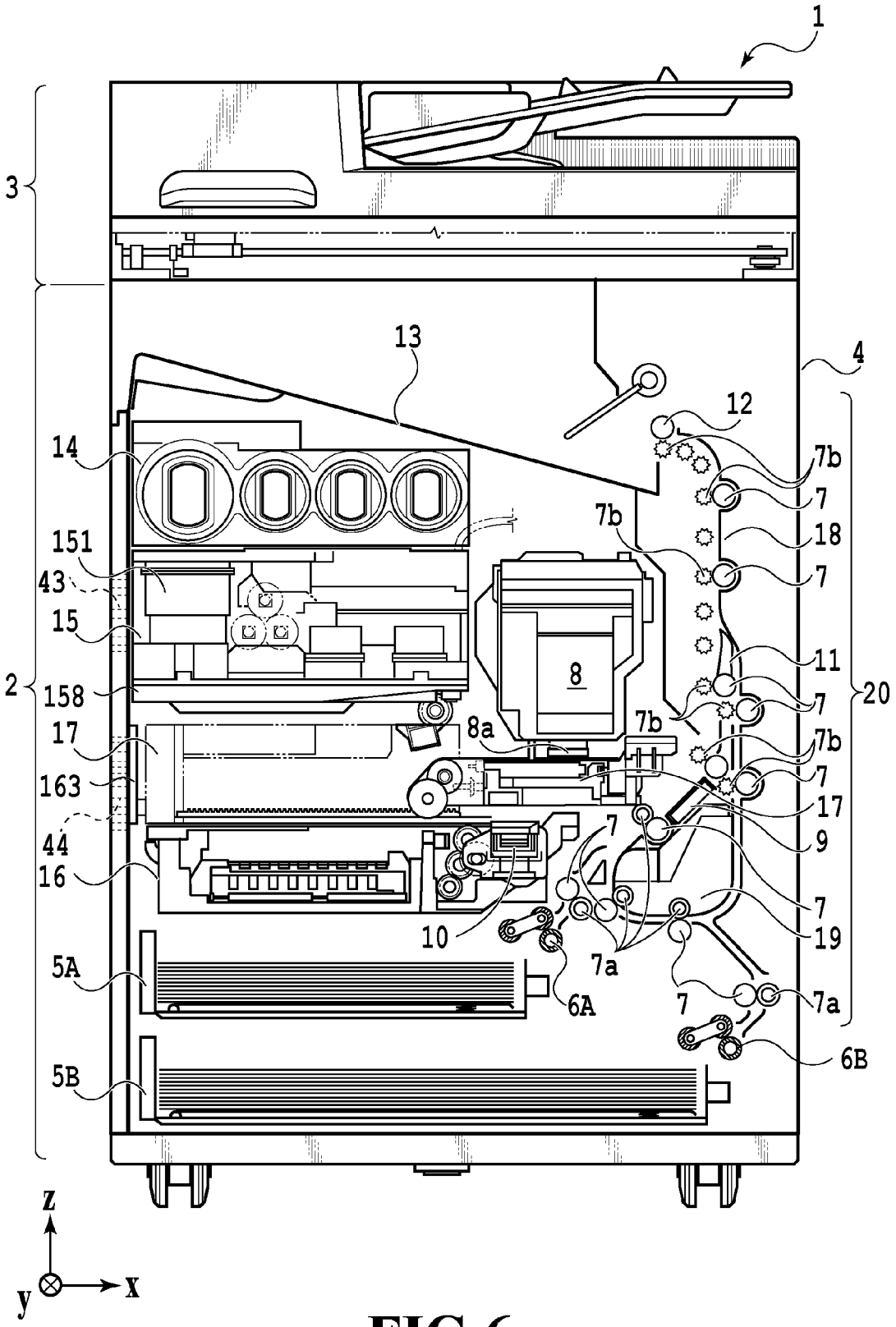
FIG. 6 is a diagram in a case where the printing apparatus is in a maintenance state.

FIG. 6 is a diagram in a case where the printing apparatus 1 is in the maintenance state. At the time of moving the print head 8 from the standby position shown in FIG. 1 to the maintenance position shown in FIG. 6, the print controller 202 moves the cap unit 10 in the vertically downward direction as well as moving the print head 8 upward in the vertical direction. Then, the print controller 202 moves the wiping unit 17 in the rightward direction in FIG. 6 from the evacuate position. After this, the print controller 202 moves the print head 8 in the vertically downward direction and moves the print head 8 to the maintenance position where the maintenance operation can be performed.

On the other hand, at the time of moving the print head 8 from the printing position shown in FIG. 3 to the maintenance position shown in FIG. 6, the print controller 202 moves the print head 8 in the vertically upward direction while rotating the print head 8 by 45 degrees. Then, the print controller 202 moves the wiping unit 17 in the rightward direction from the evacuate position. After this, the print controller 202 moves the print head 8 in the vertically downward direction and moves the print head 8 to the maintenance position where the maintenance operation by the maintenance unit 16 can be performed.

<About Maintenance Unit>

Figure 7A:
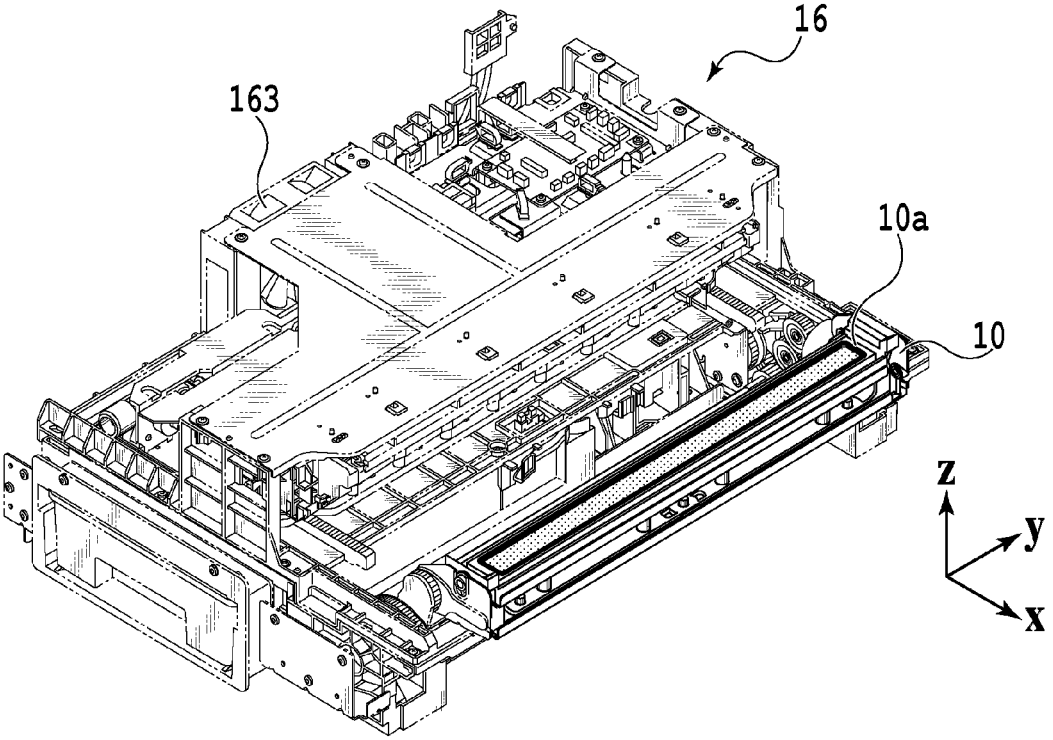
FIG. 7A and FIG. 7B are each a perspective diagram of a maintenance unit.
Figure 7B:
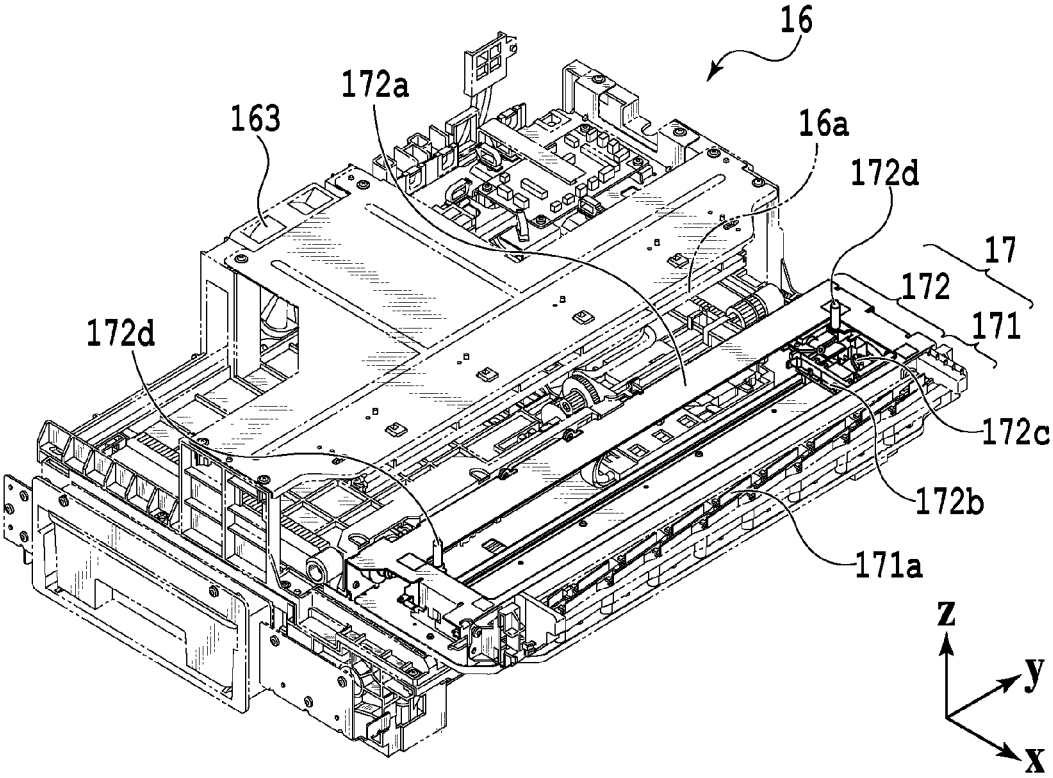

FIG. 7A is a perspective diagram showing a state where the maintenance unit 16 is at the standby position and FIG. 7B is a perspective diagram showing a state where the maintenance unit 16 is at the maintenance position. FIG. 7A corresponds to FIG. 1 and FIG. 7B corresponds to FIG. 6. In a case where the print head 8 is at the standby position, the maintenance unit 16 is at the standby position shown in FIG. 7A and the cap unit 10 has moved in the vertically upward direction and the wiping unit 17 is stored inside the maintenance unit 16. The cap unit 10 has the box-shaped cap member 10*a* extending in the y-direction and by causing the cap member 10*a* to adhere closely to the ejection port surface 8*a* of the print head 8, it is possible to suppress evaporation of ink from the ejection port. Further, the cap unit 10 also includes a function to recover ink ejected by preparatory ejection and the like to the cap member 10*a* and to cause a suction pump, not shown schematically, to suck in the recovered ink.

On the other hand, at the maintenance position shown in FIG. 7B, the cap unit 10 has moved in the vertically downward direction and the wiping unit 17 is pulled out from the maintenance unit 16. The wiping unit 17 includes two wiper units (wiping members): a blade wiper unit 171 and a vacuum wiper unit 172.

In the blade wiper unit 171, blade wipers 171*a* for wiping the ejection port surface 8*a* along the x-direction are arranged in the y-direction so as to cover a length corresponding to an array area of the ejection ports. At the time of performing the wiping operation by using the blade wiper unit 171, the wiping unit 17 moves the blade wiper unit 171 in the x-direction in the state of being positioned at a height where the print head 8 is capable of coming into contact with the blade wiper 171*a*. By this movement, the ink or the like sticking to the ejection port surface 8*a* is wiped off by the blade wiper 171*a*.

At the entrance of the maintenance unit 16 at the time of the blade wiper 171*a* being stored, a wet wiper cleaner 16*a* for giving a wet liquid to the blade wiper 171*a* as well as removing ink sticking to the blade wiper 171*a* is arranged. Each time the blade wiper 171*a* is stored in the maintenance unit 16, sticking substances are removed by the wet wiper cleaner 16*a* and a wet liquid is applied. Then, at the time of wiping the ejection port surface 8*a* next, the wet liquid is transferred to the ejection port surface 8*a* and thereby smoothness between the ejection port surface 8*a* and the blade wiper 171*a* is improved.

On the other hand, the vacuum wiper unit 172 has a flat plate 172*a* having an opening extending in the y-direction, a carriage 172*b* capable of moving within the opening in the y-direction, and a vacuum wiper 172*c* mounted on the carriage 172*b*. The vacuum wiper 172*c* is arranged so as to be capable of wiping the ejection port surface 8*a* in the y-direction accompanying the movement of the carriage 172*b*. At the front end of the vacuum wiper 172*c*, a suction port connected to a suction pump, not shown schematically, is formed. Because of this, in a case where the carriage 172*b* is moved in the y-direction while causing the suction pump to operate, the ink or the like sticking to the ejection port surface 8*a* of the print head 8 is sucked into the suction port while being wiped and collected by the vacuum wiper 172*c*. At this time, a positioning pin 172*d* provided at both ends of the flat plate 172*a* and the opening is made use of for positioning the vacuum wiper 172*c* for the ejection port surface 8*a*.

<About Ink Supply Unit (Ink Circulation System)>

Figure 8:
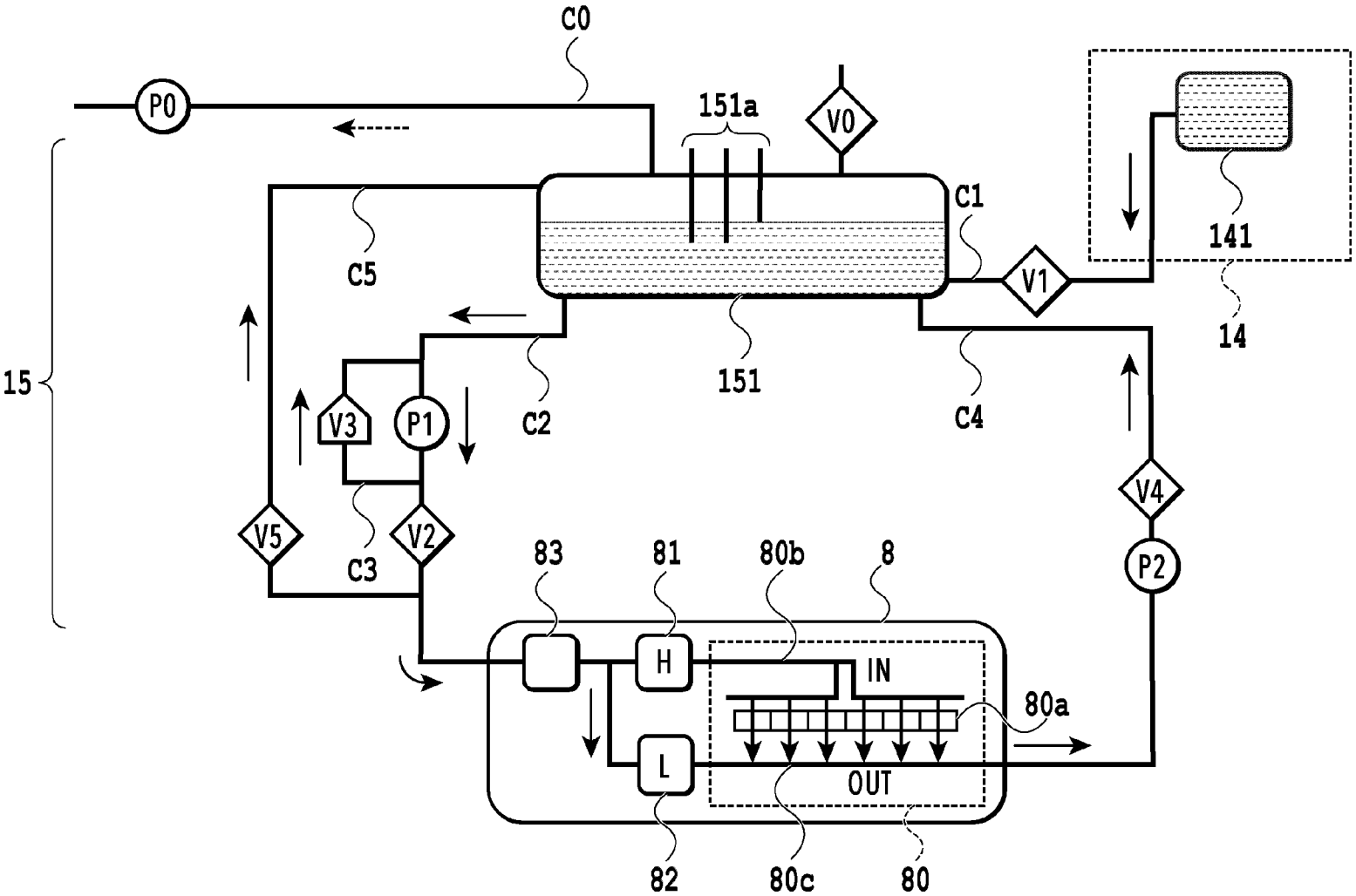
FIG. 8 is a diagram explaining a flow path configuration of an ink circulation system.

FIG. 8 is a diagram including the ink supply unit 15 adopted in the ink jet printing apparatus 1 of the present embodiment. The flow path configuration of the ink circulation system of the present embodiment is explained by using FIG. 8. The ink supply unit 15 supplies ink supplied from the ink tank unit 14 to the print head 8 (head unit). In FIG. 8, the configuration of one color ink is shown, but in fact, such a configuration is prepared for each ink color. The ink supply unit 15 is controlled basically by the ink supply control unit 209 shown in FIG. 2. In the following, each configuration of the ink supply unit 15 is explained.

Ink circulates mainly between a sub tank 151 and the print head 8. In the print head 8, the ejection operation of ink is performed based on image data and the ink not ejected is recovered again to the sub tank 151.

The sub tank 151 that stores a predetermined amount of ink is connected to a supply flow path C2 for supplying ink to the print head 8 and a recovery flow path C4 for recovering ink from the print head 8. That is, the circulation flow path (circulation path) through which ink circulates is made up of the sub tank 151, the supply flow path C2, the print head 8, and the recovery flow path C4. Further, the sub tank 151 connected to an air flow path C0 through which air flows. The air flow path C0 is an atmosphere communication flow path through which an atmosphere open value V0 communicates with the atmosphere.

In the sub tank 151, a liquid surface detection unit 151*a* including a plurality of electrode pins is provided. It is possible for the ink supply control unit 209 to grasp the height of the ink liquid surface, that is, the ink remaining amount within the sub tank 151 by detecting whether or not there is a conduction current between the plurality of pins. A decompression pump P0 (within-tank decompression pump) is a negative pressure generation source for decompressing the inside of the sub tank 151. The atmosphere open valve V0 is a valve for switching whether or not to cause the inside of the sub tank 151 to communicate with the atmosphere.

A main tank 141 is a tank storing ink that is supplied to the sub tank 151. The main tank 141 has a configuration detachable from the printing apparatus main body. On the way of a tank connection flow path C1 that connects the sub tank 151 and the main tank 141, a tank supply valve V1 for switching connections of the sub tank 151 and the main tank 141 is arranged.

In a case of detecting that the ink within the sub tank 151 becomes smaller than a predetermined amount by the liquid surface detection unit 151*a*, the ink supply control unit 209 closes the atmosphere open valve V0, a supply valve V2, a recovery valve V4, and a head exchange valve V5. Further, the ink supply control unit 209 opens the tank supply valve V1. In this state, the ink supply control unit 209 causes the decompression pump P0 to operate. Then, the pressure inside the sub tank 151 becomes negative and ink is supplied from the main tank 141 to the sub tank 151. In a case of detecting that the ink within the sub tank 151 exceeds a predetermined amount by the liquid surface detection unit 151*a*, the ink supply control unit 209 closes the tank supply valve V1 and stops the decompression pump P0.

The supply flow path C2 is a flow path for supplying ink from the sub tank 151 to the print head 8 and on the way thereof, a supply pump P1 and the supply valve V2 are arranged. During the printing operation, by driving the supply pump P1 in the state where the supply valve V2 is open, it is possible to circulate ink in the circulation path while supplying ink to the print head 8. The amount of ink ejected per unit time by the print head 8 fluctuates in accordance with image data. The flow rate of the supply pump P1 is determined so as to be compatible also with a case where the print head 8 performs the ejection operation that maximizes the amount of ink to be consumed per unit time.

A relief flow path C3 is a flow path that is located on the upstream side of the supply valve V2 and which connects the upstream side and the downstream side of the supply pump P1. On the way of the relief flow path C3, a relief valve V3, which is a differential pressure valve, is arranged. The relief valve is not opened and closed by a drive mechanism but is spring-biased and is configured so as to open in a case where a predetermined pressure is reached. For example, in a case where the ink supply amount per unit time from the supply pump P1 is larger than the total value of the ejection amount per unit time of the print head 8 and the flow rate (amount of ink to be drawn) per unit time in the recovery pump P2, the relief valve V3 is opened in accordance with the pressure that is exerted on the relief valve V3 itself. Due to this, a circulation flow path made up of a part of the supply flow path C2 and the relief flow path C3 is formed. By providing the configuration of the relief flow path C3, the ink supply amount for the print head 8 is adjusted in accordance with the ink consumption in the print head 8, and therefore, it is possible to stabilize the pressure within the circulation path irrespective of image data.

The recovery flow path C4 is a flow path for recovering ink from the print head 8 to the sub tank 151 and on the way thereof, a recovery pump P2 and the recovery valve V4 are arranged. At the time of circulating ink within the circulation path, the recovery pump P2 functions as a negative pressure generation source to suck ink from the print head 8. By the drive of the recovery pump P2, an appropriate pressure difference arises between an IN flow path 80*b* and an OUT flow path 80*c* within the print head 8, and therefore, it is possible to circulate ink between the IN flow path 80*b* and the OUT flow path 80*c*.

The recovery valve V4 is also a valve for checking a backflow in a case where the printing operation is not being performed, that is, ink is not being circulated within the circulation path. In the circulation path of the present embodiment, the sub tank 151 is arranged above the print head 8 in the vertical direction (see FIG. 1). Because of this, in a case where the supply pump P1 and the recovery pump P2 are not driven, there is a possibility that ink flows backward from the sub tank 151 to the print head 8 due to a water head difference between the sub tank 151 and the print head 8. In order to check such a backflow, in the present embodiment, the recovery valve V4 is provided in the recovery flow path C.

The supply valve V2 also functions as a valve for preventing supply of ink from the sub tank 151 to the print head 8 in a case where the printing operation is not being performed, that is, ink is not being circulated within the circulation path.

A head exchange flow path C5 is a flow path that connects the supply flow path C2 and an air chamber (space where ink is not stored) of the sub tank 151 and on the way thereof, the head exchange valve V5 is arranged. One end of the head exchange flow path C5 is connected to the upstream of the print head 8 in the supply flow path C2 and connected to the downstream side of the supply valve V2. The other end of the head exchange flow path C5 is connected to the upper portion of the sub tank 151 and communicates with the air chamber inside the sub take 151. The head exchange flow path C5 is made use of in a case where ink is drawn out from the print head 8 in use, such as at the time of exchanging the print head 8 or transporting the printing apparatus 1. The head exchange valve V5 is controlled by the ink supply control unit 209 so as to close except for a case where the print head 8 is filled with ink and a case where ink is recovered from the print head 8.

Next, the flow path configuration within the print head 8 is explained. The ink supplied to the print head 8 by the supply flow path C2 is supplied to a first negative pressure control unit 81 and a second negative pressure control unit 82 after passing a filter 83. In the first negative pressure control unit 81, the control pressure is set to a weak negative pressure (negative pressure whose pressure difference from the atmospheric pressure is small). In the second negative pressure control unit 82, the control pressure is set to a strong negative pressure (negative pressure whose pressure difference from the atmospheric pressure is large). The pressures in the first negative pressure control unit 81 and in the second negative pressure control unit 82 are generated in an appropriate range by the drive of the recovery pump P2.

In an ejection unit 80 configured to eject a liquid (specifically, ink), a plurality of printing element substrates 80*a* on which a plurality of ejection ports is arrayed is arranged and a long ejection port row is formed. The common supply flow path 80*b* (IN flow path) for guiding ink supplied by the first negative pressure control unit 81 and the common recovery flow path 80*c* (OUT flow path) for guiding ink supplied by the second negative pressure control unit 82 are also extending in the array direction of the printing element substrate 80*a*. Further, on the individual printing element substrate 80*a*, an individual supply flow path connected with the common supply flow path 80*b* and an individual recovery flow path connected with the common recovery flow path 80*c* are formed. Because of this, on the individual printing element substrate 80*a*, a flow of ink is generated, which flows in from the common supply flow path 80*b* where the negative pressure is relatively weak and flows out to the common recovery flow path 80*c* where the negative pressure is relatively strong. In the path of the individual supply flow path and the individual recovery flow path, a pressure chamber that communicates with each ejection port and is filled with ink is provided and a flow of ink occurs also at the ejection port and in the pressure chamber where printing is not being performed. In a case where the ejection operation is performed on the printing element substrate 80*a*, a part of the ink that moves from the common supply flow path 80*b* to the common recovery flow path 80*c* is consumed by being ejected from the ejection port, but the ink that is not ejected moves to the recovery flow path C4 via the common recovery flow path 80*c*.

Figure 9A:
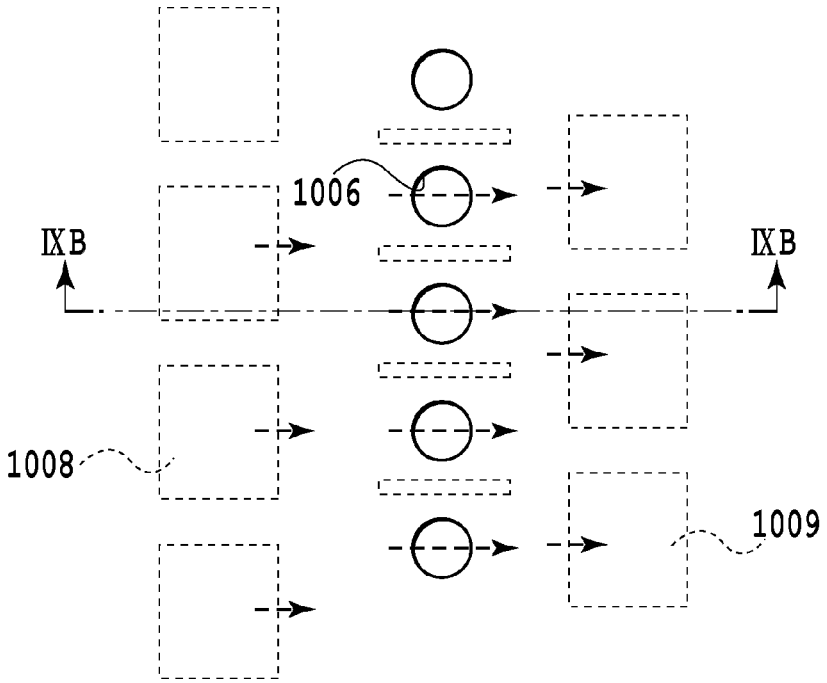
FIG. 9A and FIG. 9B are diagrams explaining an ejection port and a pressure chamber.
Figure 9B:
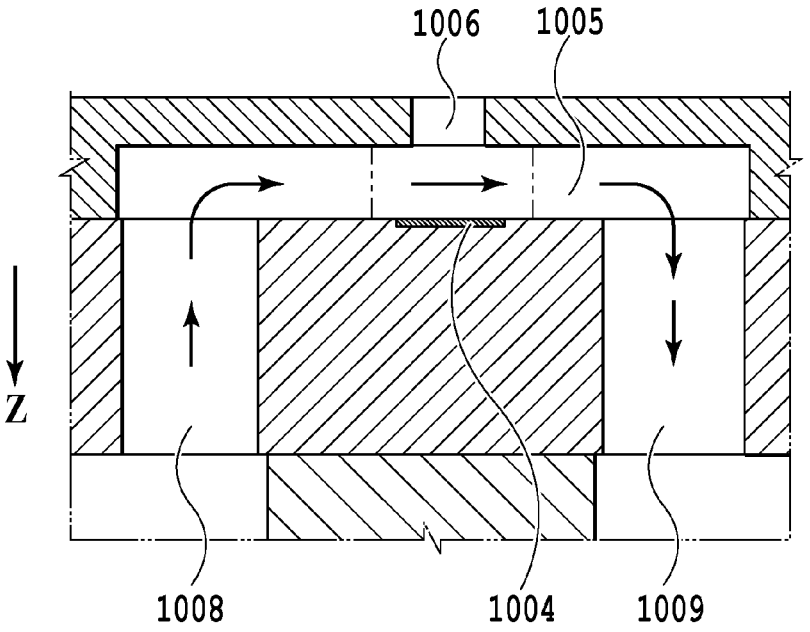

FIG. 9A is a planar schematic diagram in which a part of the printing element substrate 80*a* is enlarged and FIG. 9B is a sectional schematic diagram at a section line IXB-IXB in FIG. 9A. On the printing element substrate 80*a*, a pressure chamber 1005 filled with ink and an ejection port 1006 that ejects ink are provided. In the pressure chamber 1005, at the position facing the ejection port 1006, a printing element 1004 is provided. Further, on the printing element substrate 80*a*, an individual supply flow path 1008 connected with the common supply flow path 80*b* and an individual recovery flow path 1009 connected with the common recovery flow path 80*c* are formed in plurality, respectively, for each ejection port 1006.

With the above-described configuration, on the printing element substrate 80*a*, a flow of ink is generated, which flows in from the common supply flow path 80*b* where the negative pressure is relatively weak (absolute value of pressure is high) and flows out to the common recovery flow path 80*c* where the negative pressure is relatively strong (absolute value of pressure is low). In more detail, ink flows in the order of the common supply flow path 80*b*→the individual supply flow path 1008→the pressure chamber 1005→the individual recovery flow path 1009→the common recovery flow path 80*c*. In a case where ink is ejected by the printing element 1004, part of the ink moving from the common supply flow path 80*b* to the common recovery flow path 80*c* is discharged to the outside of the print head 8 by being ejected from the ejection port 1006. On the other hand, the ink that is not ejected from the ejection port 1006 is recovered to the recovery flow path C4 via the common recovery flow path 80*c*.

In a case where the printing operation is performed, the ink supply control unit 209 closes the tank supply valve V1 and the head exchange valve V5, opens the atmosphere open valve V0, the supply valve V2, and the recovery valve V4, and drives the supply pump P1 and the recovery pump P2. Due to this, a circulation path of the sub tank 151→the supply flow path C2→the print head 8→the recovery flow path C4→the sub tank 151 is established. In a case where the ink supply amount per unit time from the supply pump P1 is larger than the total value of the ejection amount per unit time of the print head 8 and the flow rate per unit time in the recovery pump P2, ink flows into the relief flow path C3 from the supply flow path C2. Due to this, the flow rate of the ink that flows into the print head 8 from the supply flow path C2 is adjusted.

In a case where the printing operation is not being performed, the ink supply control unit 209 stops the supply pump P1 and the recovery pump P2 and closes the atmosphere open valve V0, the supply valve V2, and the recovery valve V4. Due to this, the flow of ink within the print head 8 stops and a backflow due to the water head difference between the sub tank 151 and the print head 8 is suppressed. Further, by closing the atmosphere open valve V0, leakage of ink and evaporation of ink from the sub tank 151 are suppressed.

In a case of recovering ink from the print head 8, the ink supply control unit 209 closes the atmosphere open valve V0, the tank supply valve V1, the supply valve V2, and the recovery valve 4, opens the head exchange valve V5, and drives the decompression pump P0. Due to this, the inside of the sub tank 151 enters a negative pressure state and the ink within the print head 8 is recovered to the sub tank 151 via the head exchange flow path C5. As described above, the head exchange valve V5 is a valve that is closed in the normal printing operation and at the time of standby and opened at the time of recovering ink from the print head 8. The head exchange valve V5 is also opened at the time of filling the head exchange flow path C5 with ink in a case where the print head 8 is filled.

<About Position Configuration of Each Unit>

Figure 10:
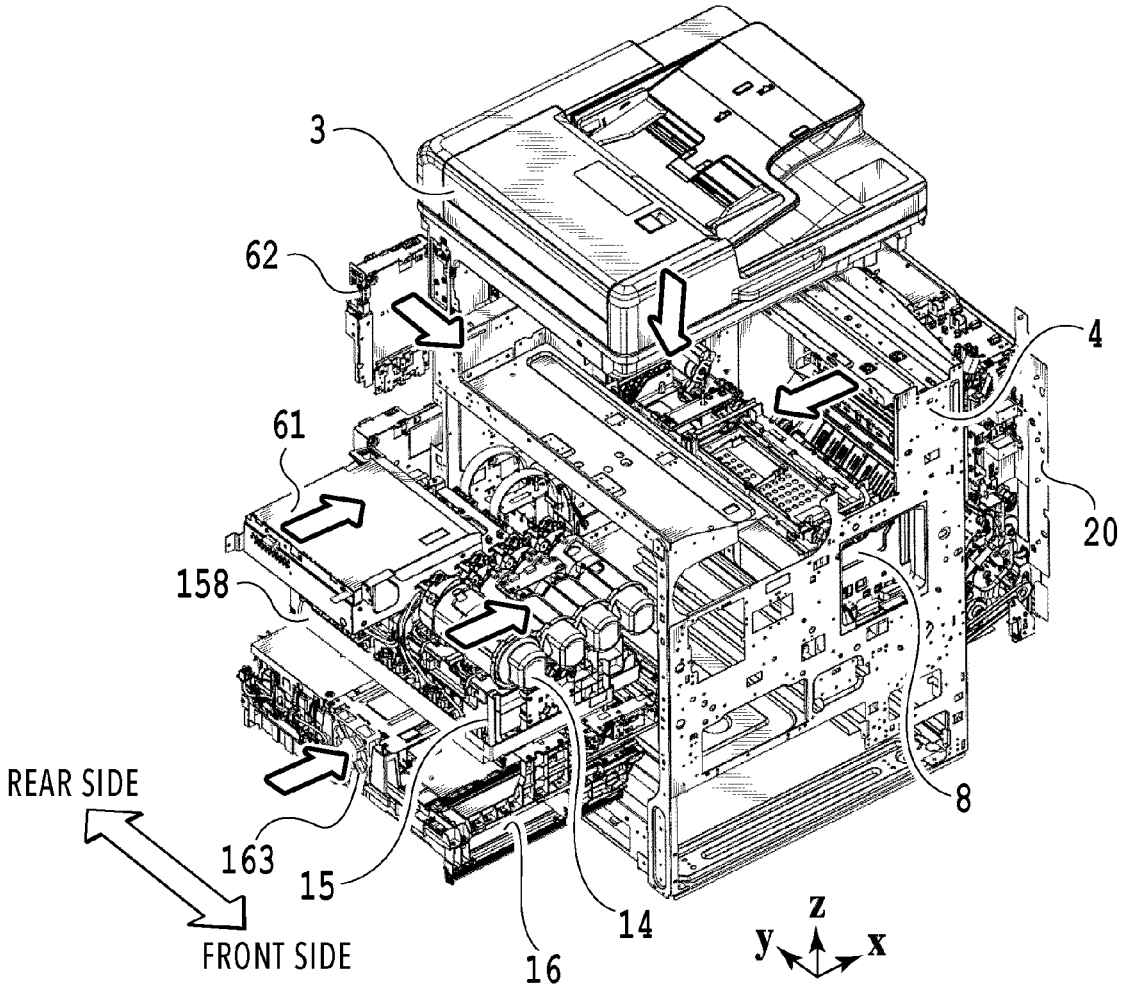
FIG. 10 is an exploded perspective diagram of the printing apparatus.

FIG. 10 is an exploded perspective diagram of the printing apparatus 1. By using FIG. 10 and FIG. 1, a positional relationship of each unit and a detachment direction are explained. The side facing forward of the printing apparatus 1 shown in FIG. 1 is called the front side and the side facing backward is called the rear side. The side on the right of the printing apparatus 1 shown in FIG. 1 is called the right side and the side on the left is called the left side. As shown in FIG. 10, the scanner unit 3 is attached to the ceiling surface of the casing 4 (upward in the direction of force of gravity). The conveyance unit 20 is attached from the right side of the casing 4. The print head 8 is attached from the front side of the casing 4 (in FIG. 10, the state where the print head 8 is already attached). The maintenance unit 16 is attached from the left side of the casing 4. The ink supply unit 15 to which the ink tank unit 14 is attached is attached from the left side of the casing 4. The ink tank unit 14 is attached from the front side. A power supply unit 61 is attached from the left side of the casing 4. A printed circuit board 62 is attached from the rear side of the casing 4. Each of these units or the like is configured so as to be removal by a user. For example, a guide member, not shown schematically, is provided to the casing and each unit or the like is configured so as to be detachable from the casing 4 in a slide manner along the guide member.

Each of these units or the like is detachable independently of other units or the like. For example, in a case where it becomes necessary to exchange parts of the conveyance unit 20 due to, for example, a failure, it is possible for a user to remove only the conveyance unit 20 without the need to remove other units (for example, the ink supply unit 15). This is also true with other units or the like. As described above, each unit or the like being configured so as to be detachable independently of other units or the like, serviceability in a case where parts are exchanged or the like is improved. That is, it is possible to remove a target unit or the like alone, and therefore, it is possible to quickly remove only a required unit.

Figure 11:
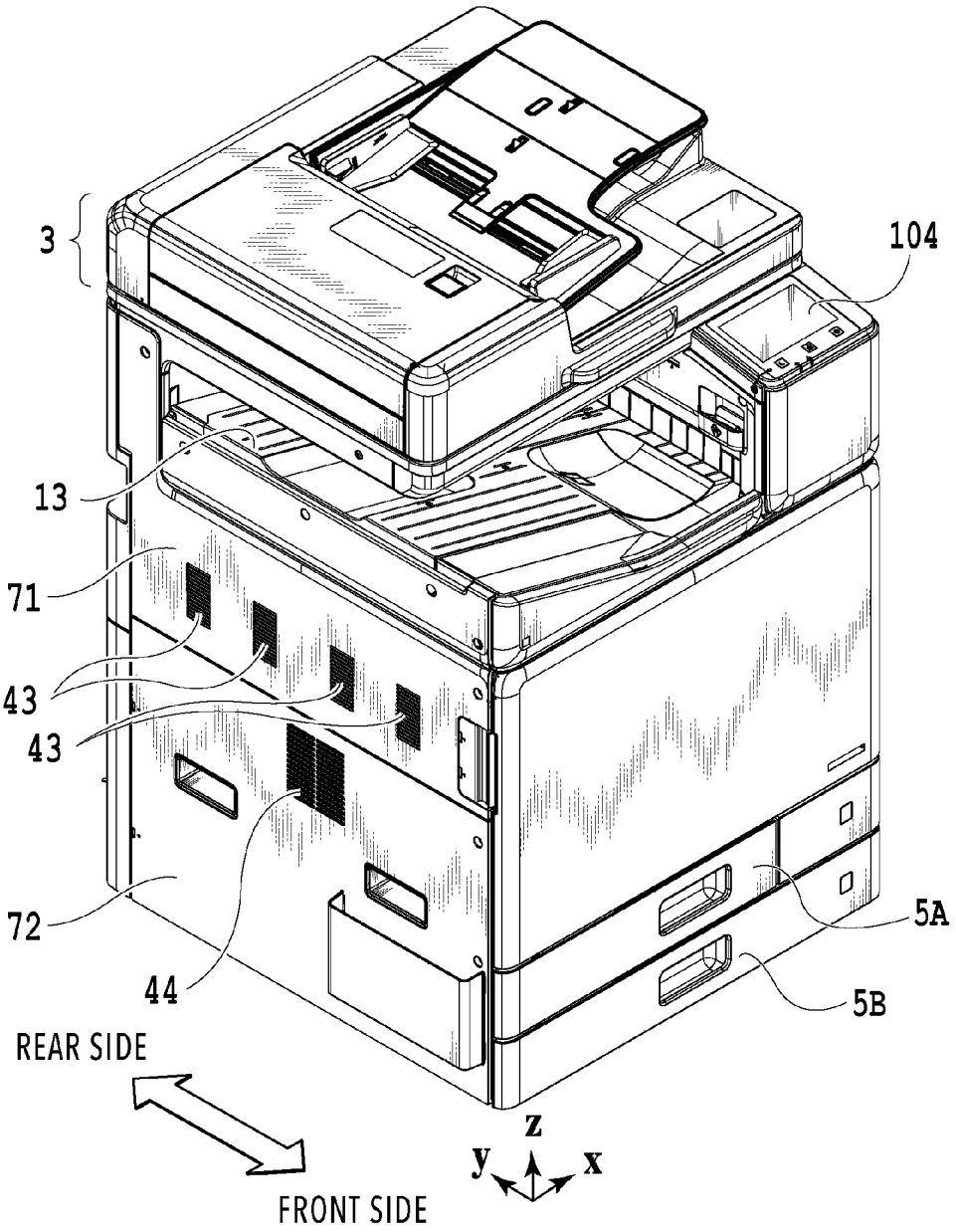
FIG. 11 is a perspective diagram showing an outer appearance of the printing apparatus.

FIG. 11 is a perspective diagram showing an outer appearance of the printing apparatus 1. FIG. 11 shows the printing apparatus 1 in a state where each unit or the like shown FIG. 10 is attached and an outer cover is attached. A first outer cover 71 on the left side of the printing apparatus 1 is provided with first openings (hereinafter, referred to as air supply ports 43). The first outer cover 71 corresponds to the outer unit of the ink supply unit 15. As shown in FIG. 11, the first outer cover 71 is provided with the four air supply ports 43. As shown in FIG. 1, in a case where the ink supply unit 15 is attached to the printing apparatus 1, the sub tank 151 of each color is arranged on the left side. Each air supply port 43 is provided at a position facing each sub tank 151 in the horizontal direction.

A second outer cover 72 on the left side of the printing apparatus 1 is provided with a second opening (hereinafter, referred to as an evacuation port 44). The second outer cover 72 corresponds to the outer unit of the maintenance unit 16. As shown in FIG. 1 and FIG. 10, the maintenance unit 16 includes an evacuation fan 163. The evacuation port 44 is provided at a position facing the evacuation fan 163 in the horizontal direction.

<About Conveyance Path Cleaning Unit>

Figure 12:
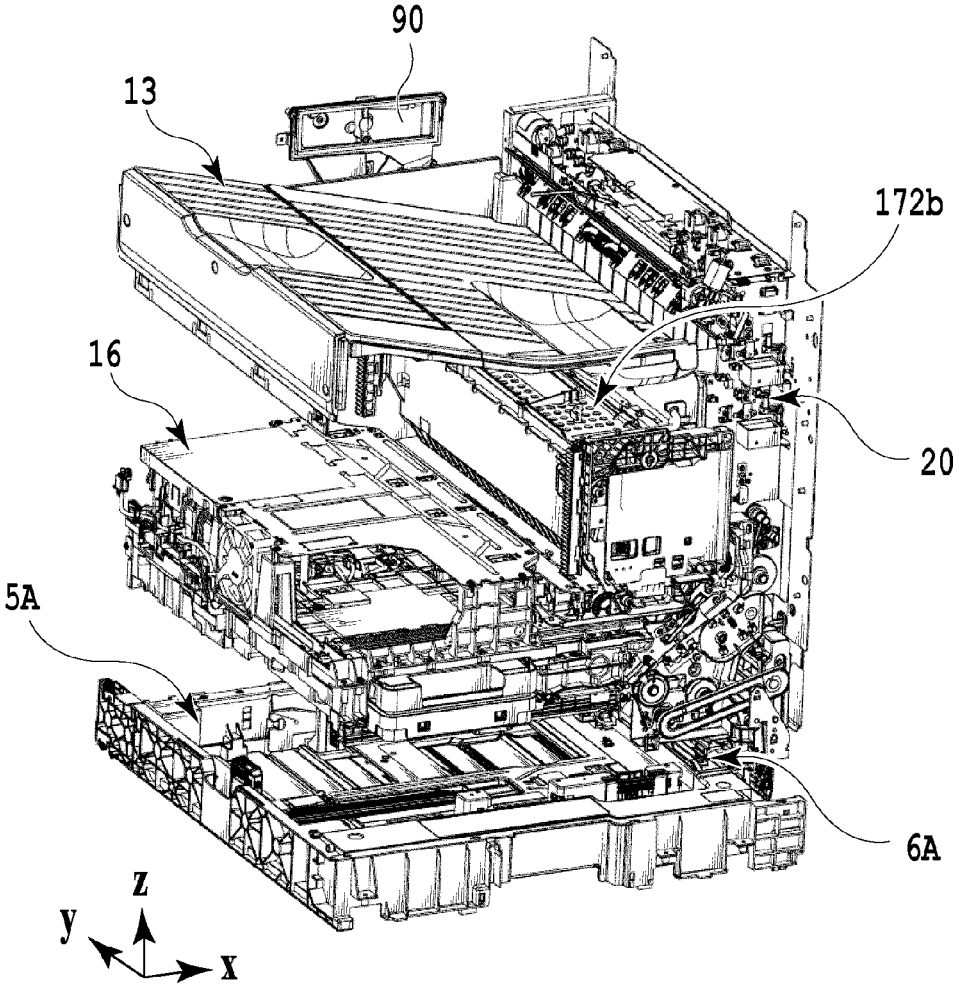
FIG. 12 is a perspective diagram showing an internal structure of the printing apparatus.

In the following, the conveyance path cleaning unit in the present embodiment is explained by using FIG. 12 to FIG. 17B. FIG. 12 is a perspective diagram showing a part of the internal structure that appears in a case where all the outer covers of the printing apparatus 1 are removed. As described previously, the printing apparatus 1 has the first cassette 5A and the feed unit 6A for sheet feed, the discharge tray 13, the maintenance unit 16, the carriage 172*b*, and the conveyance unit 20 and as shown in FIG. 12, the printing apparatus 1 further has a conveyance path cleaning unit 90. The conveyance path cleaning unit 90 is a unit that is attached to the conveyance unit 20 for removing foreign substances from the conveyance path. As the foreign substances referred to here, mist of ink, which floats as minute liquid droplets, of the ink ejected from the ejection port 1006, paper powder generated by a printing media being conveyed at a high speed, and the like are supposed. The conveyance path cleaning unit recovers mist floating in the conveyance path and discharges the mist to the outside of the apparatus, blows the paper powder scattered in the conveyance path from downstream side in the conveyance direction toward the upstream side, and so on. The recovery-target mist floats within the printing apparatus 1, specifically, in the printing area and the conveyance path of a printing medium. Here, the printing area refers to the area in which image formation by ink ejection is performed actually during the printing operation and means the neighboring areas including the print head 8 and the platen 9.

Figure 13A:
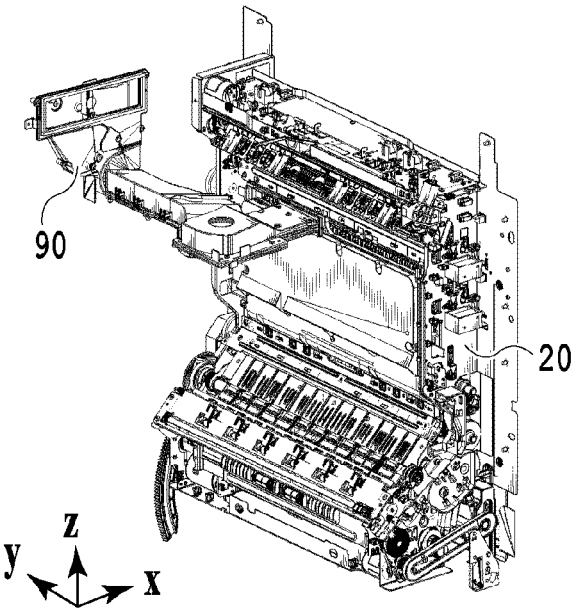
FIG. 13A to FIG. 13C are diagrams explaining a positional relationship between a conveyance path cleaning unit and a conveyance unit.
Figure 13B:
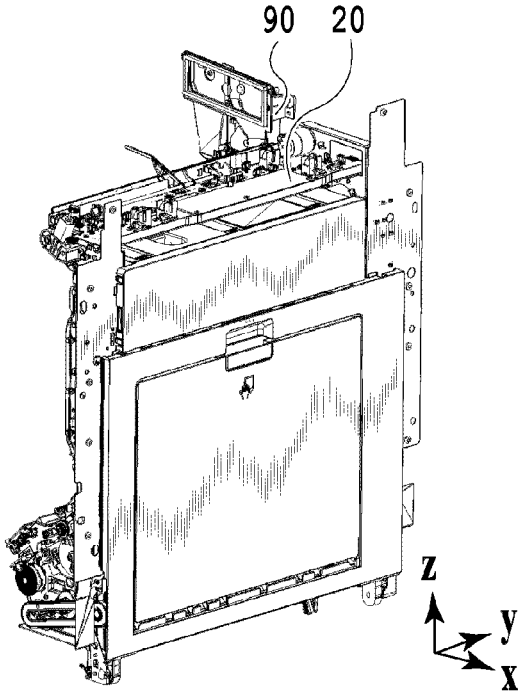
Figure 13C:
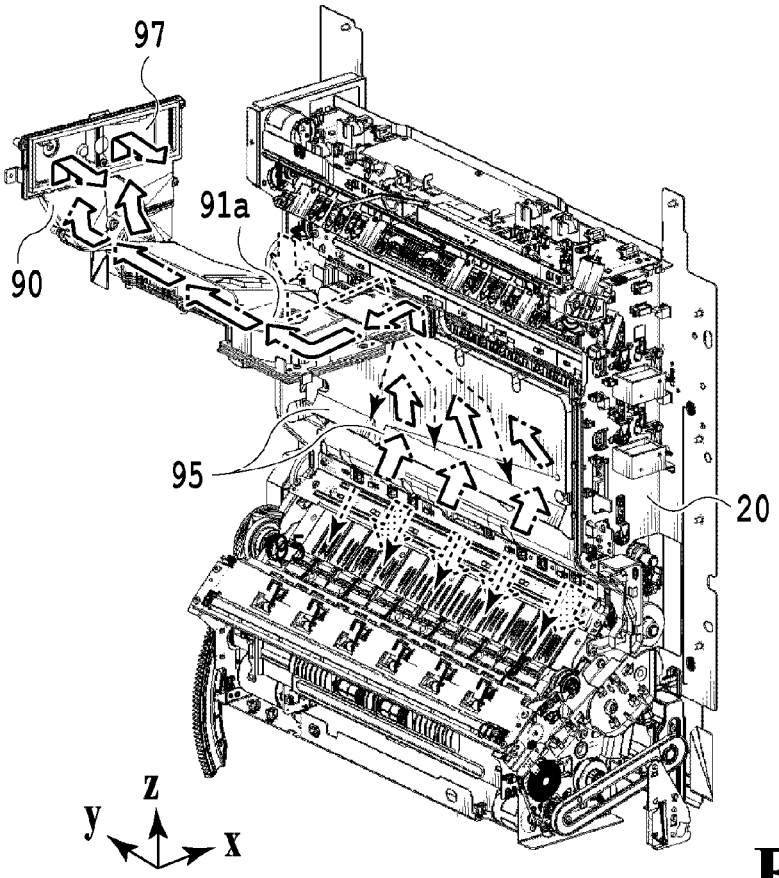

FIG. 13A to FIG. 13C are diagrams showing a positional relationship between the conveyance path cleaning unit 90 and the conveyance unit 20. In detail, FIG. 13A and FIG. 13B are each a perspective diagram in which only the conveyance unit 20 and the conveyance path cleaning unit 90 are taken out of the parts configuring the printing apparatus 1. The conveyance path cleaning unit 90 is configured so as to be removable from the conveyance unit 20. Further, FIG. 13C is a diagram showing a flow of air generated by the conveyance path cleaning unit 90 in the conveyance unit 20 and the conveyance path cleaning unit 90. Broken line arrows in FIG. 13C show the way air sucked in from a suction port 91*a* by the drive of a blower fan 91 (see FIG. 14A and FIG. 14B), to be described later, passes through an air sending flow path 92 (see FIG. 15A) within the conveyance unit 20 and reaches the printing area by being sent to the conveyance path of a printing medium. On the other hand, one-dot chain line arrows in FIG. 13C show the way the air including mist generated in the printing area is recovered from a recovery port 95. The recovered air passes through an evacuation flow path 96 (see FIG. 15A, FIG. 15B) within the conveyance path cleaning unit 90 and is finally discharged to the outside of the printing apparatus 1 from an evacuation port 97.

Figure 14A:
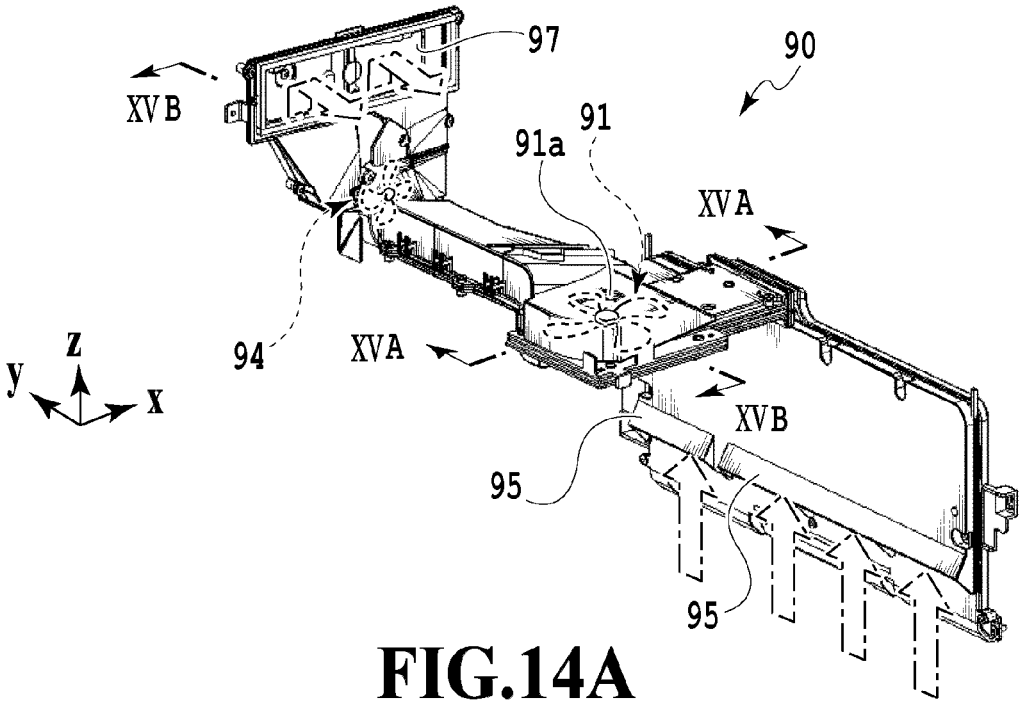
FIG. 14A and FIG. 14B are each a perspective diagram of the conveyance path cleaning unit.
Figure 14B:
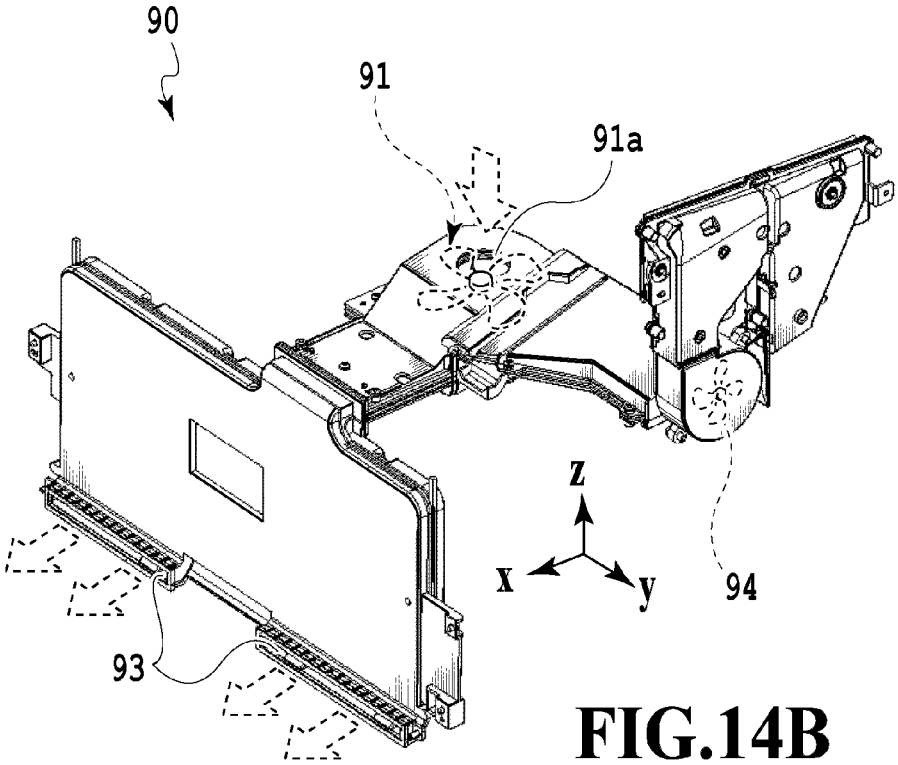
Figure 15A:
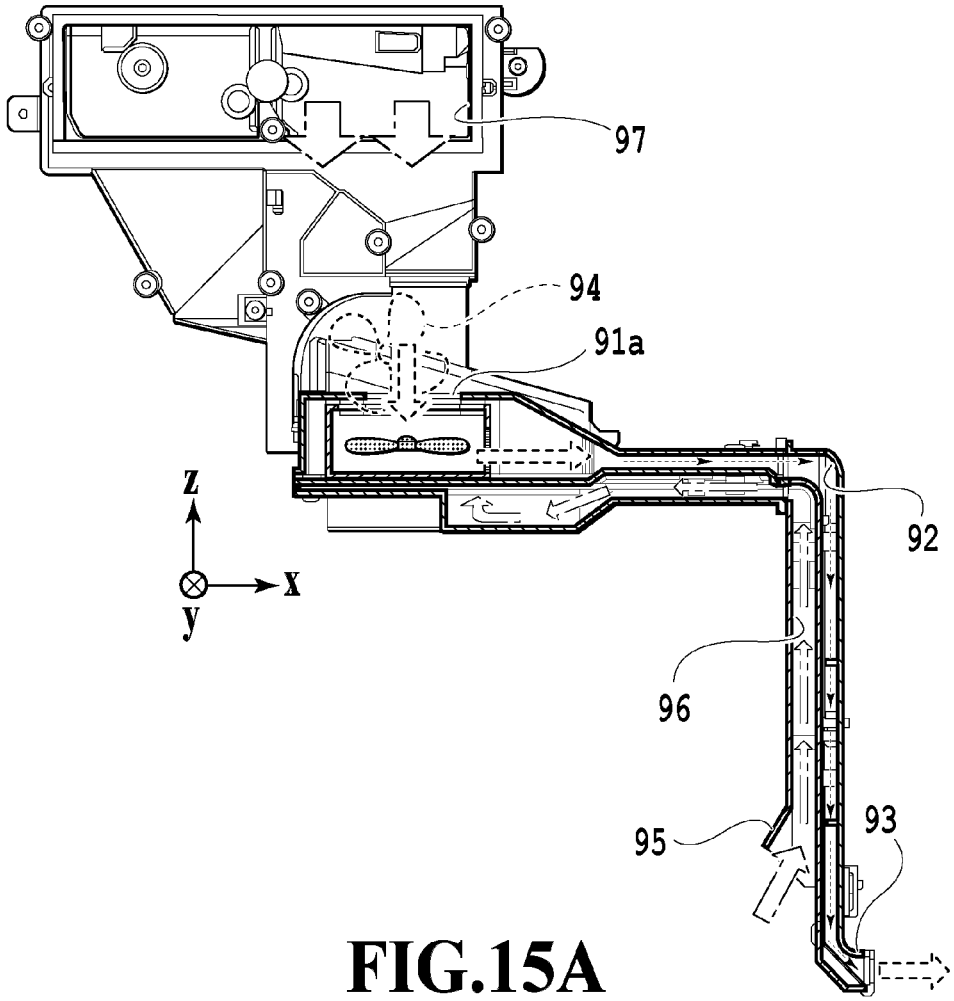
FIG. 15A and FIG. 15B are each a section diagram of the conveyance path cleaning unit.
Figure 15B:
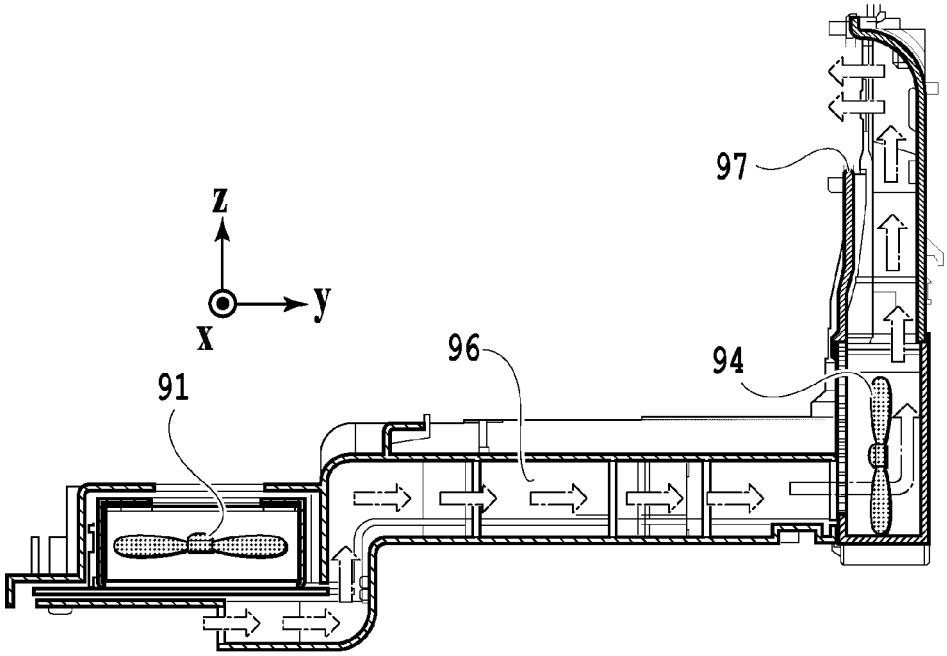

FIG. 14A and FIG. 14B are each a diagram explaining the conveyance path cleaning unit 90. In detail, FIG. 14A is a perspective diagram of the conveyance path cleaning unit 90 and FIG. 14B is a perspective diagram of the conveyance path cleaning unit 90 in a case where the conveyance path cleaning unit 90 is viewed from a direction different from that in FIG. 14A. FIG. 15A is a section diagram of the conveyance path cleaning unit 90 along a section line XVA-XVA shown in FIG. 14A and FIG. 15B is a section diagram of a part (top) of the conveyance path cleaning unit 90 along a section line XVB-XVB shown in FIG. 14A.

As shown in FIG. 14A to FIG. 15B, the conveyance path cleaning unit 90 has the blower fan 91 that sucks in air (outside air) from the suction port 91*a* and sends the air into the apparatus, the air sending flow path 92, which is a flow path of the sucked-in air, and a connection unit 93 configured to connect the conveyance path cleaning unit 90 and the conveyance unit 20. The connection unit 93 is provided so as to be located at a position facing an air sending port 1601 (see FIG. 16A and FIG. 16B) within the conveyance unit 20 in a case where the conveyance path cleaning unit 90 and the conveyance unit 20 are connected with each other.

In a case where the blower fan 91 is driven, air flows into the conveyance path cleaning unit 90 from the suction port 91*a*. The air having flowed in advances in the order of the air sending flow path 92→the connection unit 93→the air sending port 1601 within the conveyance unit 20 and flows into the conveyance path of a printing medium in the conveyance unit 20. Then, the air generates a flow of air in a direction opposite to the advancement direction (conveyance direction) of a printing medium in the conveyance path of a printing medium.

Further, as shown in FIG. 14A to FIG. 15B, the conveyance path cleaning unit 90 has an evacuation fan 94, the recovery port 95, which serves as an entrance at the time of recovering the air in the printing area by the conveyance path cleaning unit 90, the evacuation flow path 96, which is a flow path of the recovered air, and the evacuation port 97. Here, the evacuation flow path 96 is provided so as to face the air sending flow path 92 on the lower portion of the conveyance path cleaning unit 90 as shown in FIG. 15A and the direction of the flow of air within the evacuation flow path 96 is opposite to that of the flow of air within the air sending flow path 92. Further, the recovery port 95 is arranged at a position at which it is possible to recover the air blown toward the upstream side in the conveyance direction by the wind having flowed in from the air sending port 1601, described previously, in the conveyance path of a printing medium in a case where the conveyance path cleaning unit 90 and the conveyance unit 20 are connected with each other.

In a case where the evacuation fan 94 is driven, the air containing mist in the printing area is recovered into the conveyance path cleaning unit 90 from the recovery port 95.

The recovered air advances in the evacuation flow path 96 and is finally discharged to the outside of the apparatus from the evacuation port 97.

Figure 16A:
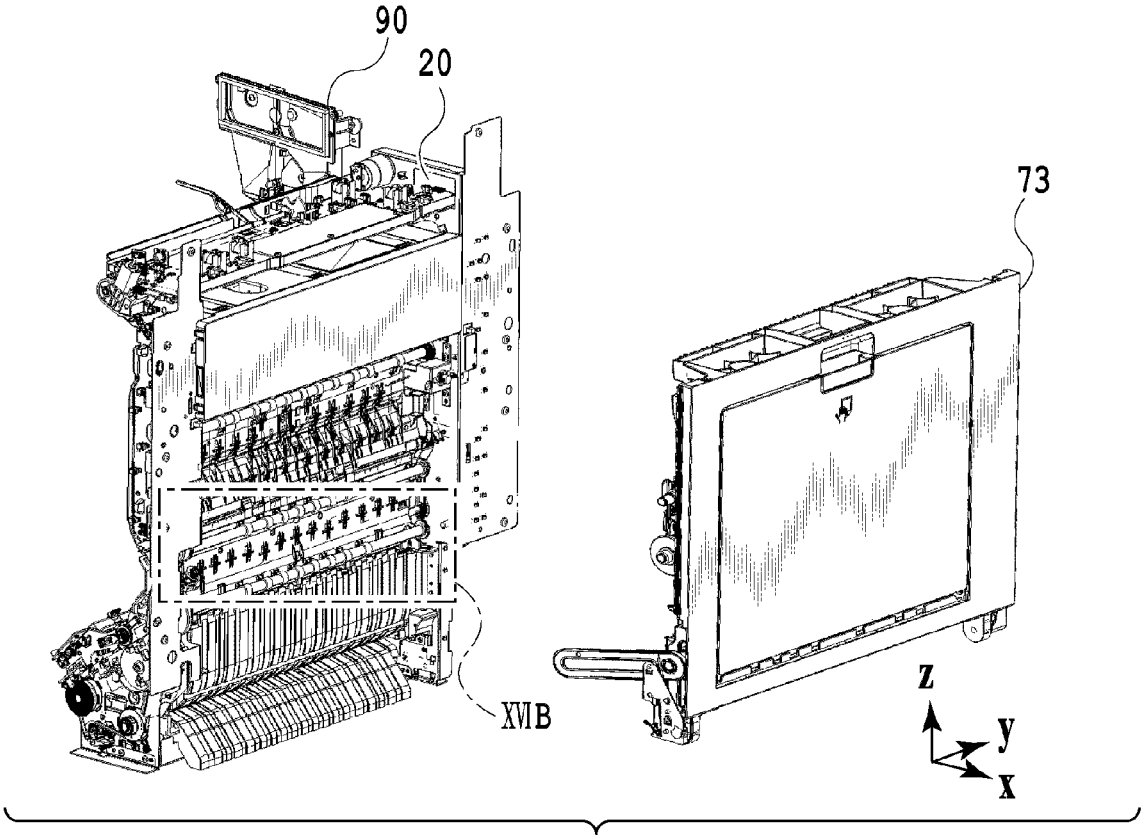
FIG. 16A and FIG. 16B are each a diagram showing a flow of air in the conveyance path of a printing medium.
Figure 16B:
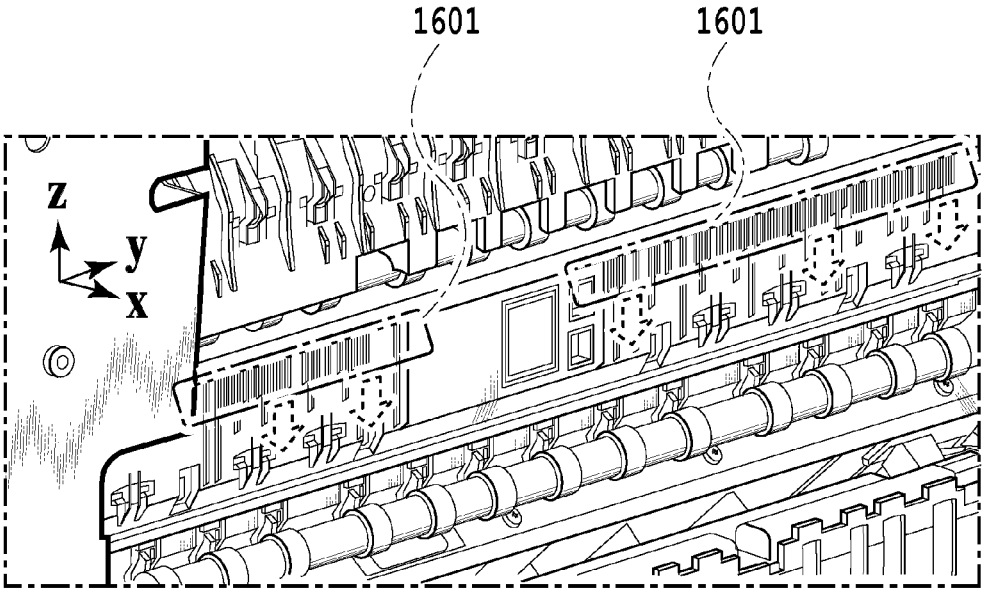
Figure 17B:
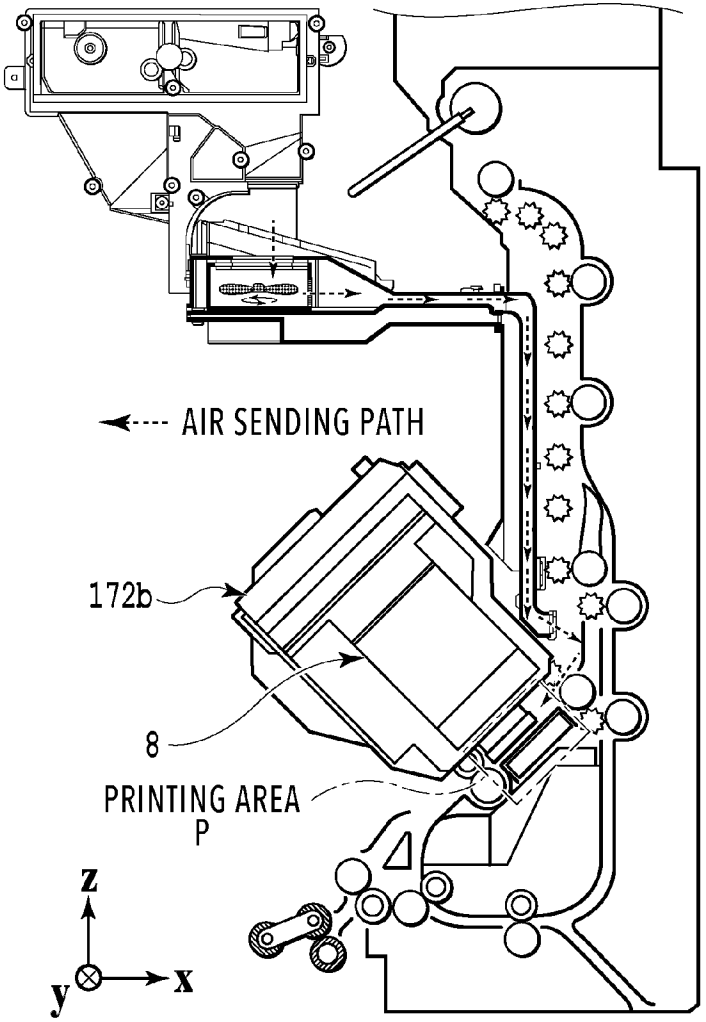
FIG. 17A and FIG. 17B are each a diagram showing a conveyance direction of a printing medium and a direction in which air flows in the conveyance path of a printing medium.
Figure 17A:
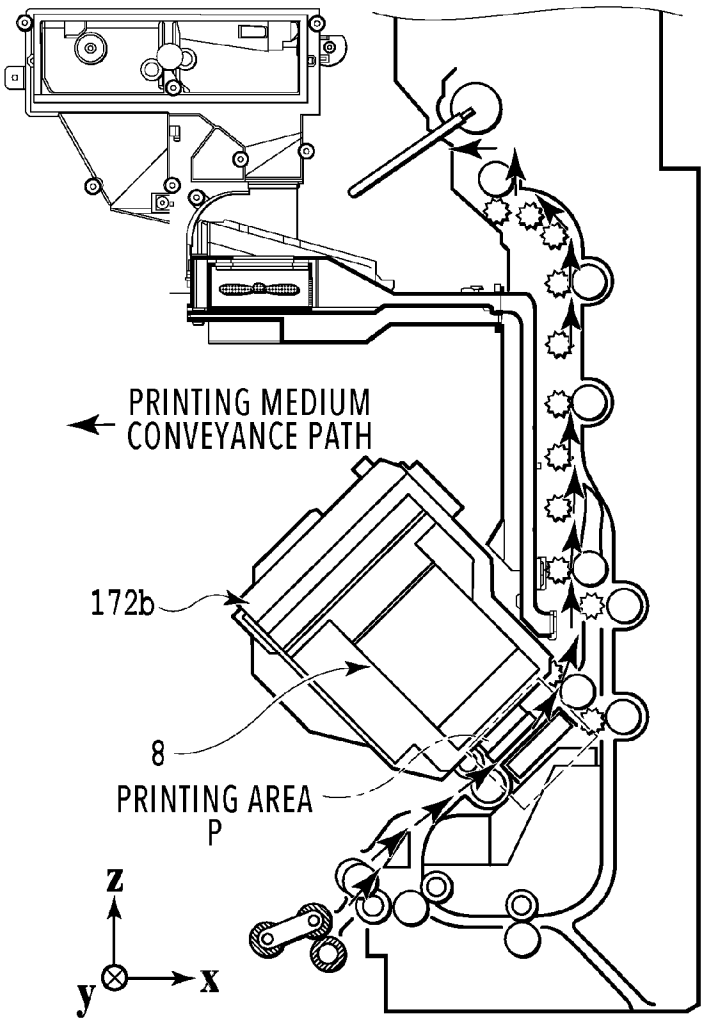

FIG. 16A and FIG. 16B are each a diagram showing a flow of air in the conveyance path of a printing medium. In detail, FIG. 16A is a perspective diagram showing a state where only the conveyance unit 20 and the conveyance path cleaning unit 90 of the parts configuring the printing apparatus 1 are taken out and an outer cover 73 is removed. Further, FIG. 16B is an enlarged diagram of the portion in the vicinity of the air sending port 1601 within the conveyance unit 20 shown in FIG. 16A. As shown in FIG. 13A to FIG. 16B, the air sucked into the conveyance path cleaning unit 90 by the blower fan 91 flows in the order of the air sending flow path 92→the connection unit 93→the air sending port 1601 and is sent out to the conveyance path of a printing medium. As a result of this, a flow of air in a direction opposite to the direction in which a printing medium advances, specifically, substantially in the direction of force of gravity (downward) is generated in the conveyance path of a printing medium as shown by broken line arrows in FIG. 16B. FIG. 17A is a diagram showing a direction in which a printing medium advances in the conveyance path of a printing medium and FIG. 17B is a diagram showing a direction in which air flows in the conveyance path of a printing medium. As shown in FIG. 17A and FIG. 17B, by the drive of the blower fan 91, in the conveyance path of a printing medium, a flow of air in a direction opposite to the direction in which a printing medium advances is generated.

<About Paper Powder Removal Sequence>

Figure 18:
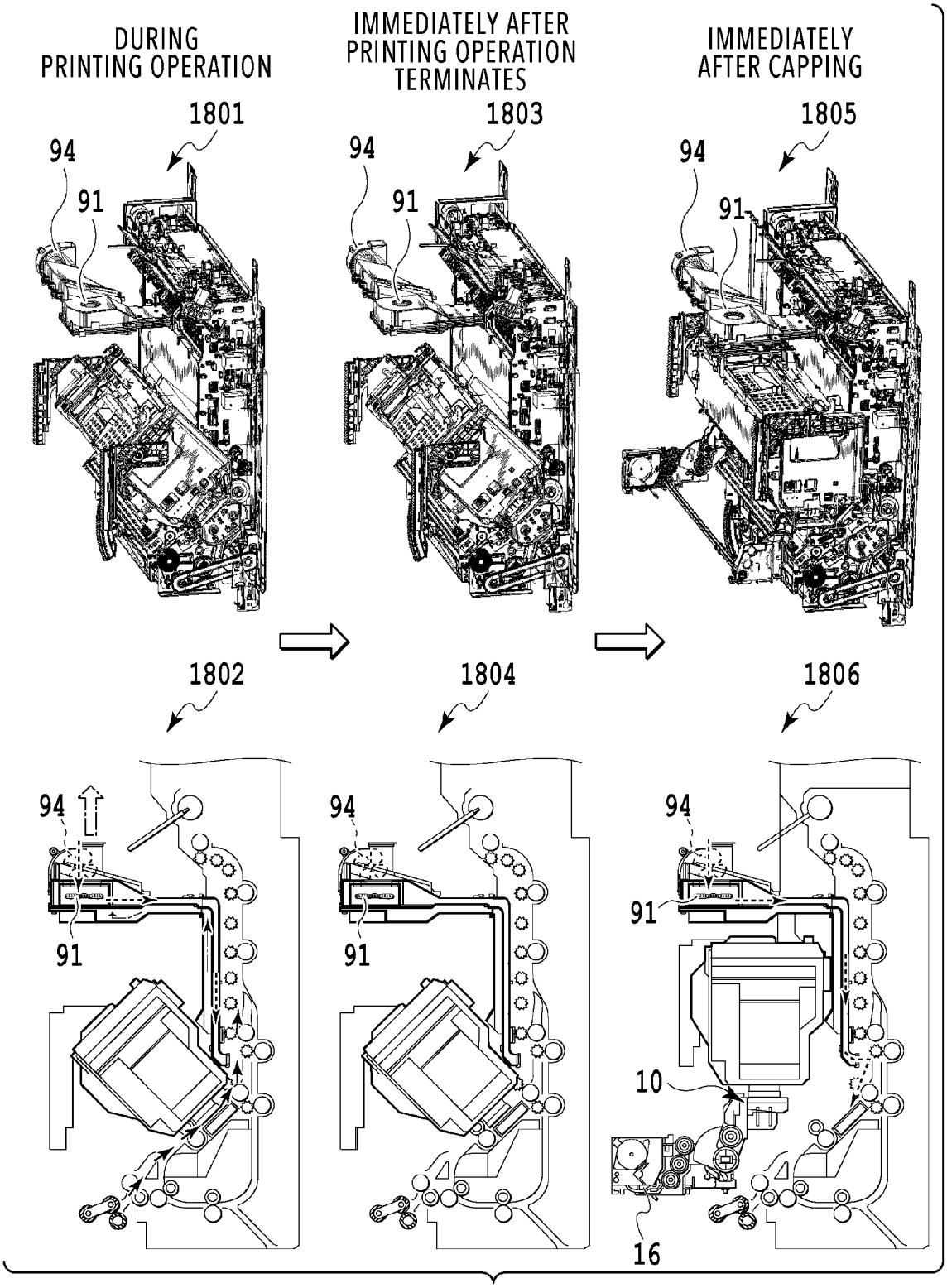
FIG. 18 is a diagram explaining an outline of a paper powder removal sequence.

In the following, an outline of the paper powder removal sequence in the present embodiment is explained by using FIG. 18. As indicated by symbols 1801 and 1802, in the period during which an image is formed (that is, during the printing operation) on a printing medium by ejecting ink from the ejection port 1006 toward the printing medium while conveying the printing medium by the conveyance unit 20, the blower fan 91 and the evacuation fan 94 are driven. As described previously, by the drive of the blower fan 91, a flow of air in a direction opposite to the advancement direction of a printing medium occurs in the conveyance path.

The mist, which is the ink ejected from the ejection port 1006 during the printing operation and floats as minute liquid droplets and advances to the downstream side by the conveyance airflow of a printing medium, is pushed back from the downstream side to the upstream side by this flow of air. As described above, by sucking in air by driving the blower fan 91 and generating a flow of air in the conveyance path, it is possible to prevent the mist from scattering in the conveyance path on the downstream side of the print head 8 in the conveyance direction of a printing medium. The air containing the mist is pushed back to near the printing area by the flow generated by the drive of the blower fan 91. Then, the air is recovered by the recovery port 95 by the flow that is generated by the drive of the evacuation fan 94, and passes through the evacuation flow path 96 and then is discharged to the outside of the printing apparatus 1 from the evacuation port 97.

After this, in a case where the printing operation based on a print job terminates, the blower fan 91 and the evacuation fan 94 are stopped. Symbols 1803 and 1804 indicate the state immediately after the printing operation terminates (in detail, the ink ejection terminates). As indicated by symbols 1803 and 1804, the flow of air in the conveyance path also stops because the drive of the blower fan 91 and the evacuation fan 94 stop. The reason these fans are stopped is that ink is no longer ejected from the ejection port 1006 in a case where the printing operation terminates and the mist is no longer generated, and therefore, it is no longer necessary to recover and discharge mist by generating a flow of air by driving the fans. However, at this time, the printing apparatus 1 is in the state where paper powder generated accompanying the conveyance of a printing medium is floating in the conveyance path and in a case where the paper powder sticks to and accumulates in the conveyance path as time elapses, this will be a factor for causing trouble, such as conveyance abnormality and a reduction in sensor sensitivity.

Consequently, in order to prevent the trouble such as this, as indicated by symbols 1805 and 1806, the blower fan 91 is driven after shifting the print head 8 from the cap-open state into the cap-closed state. Due to this, in the conveyance path, a flow of air in a direction opposite to the advancement direction of a printing medium is generated in the conveyance path and the paper powder floating in the conveyance path is pushed back to the printing area. At this time, the print head 8 is in the cap-closed state, and therefore, it is unlikely that the paper powder pushed back to the printing area sticks to the ejection port 1006 and causes an ejection failure. At this time, it may also be possible to suck in the paper powder pushed back to the printing area and discharge from the evacuation port 97 via the evacuation flow path 96 by also driving the evacuation fan 94, not only the blower fan 91.

Figure 19:
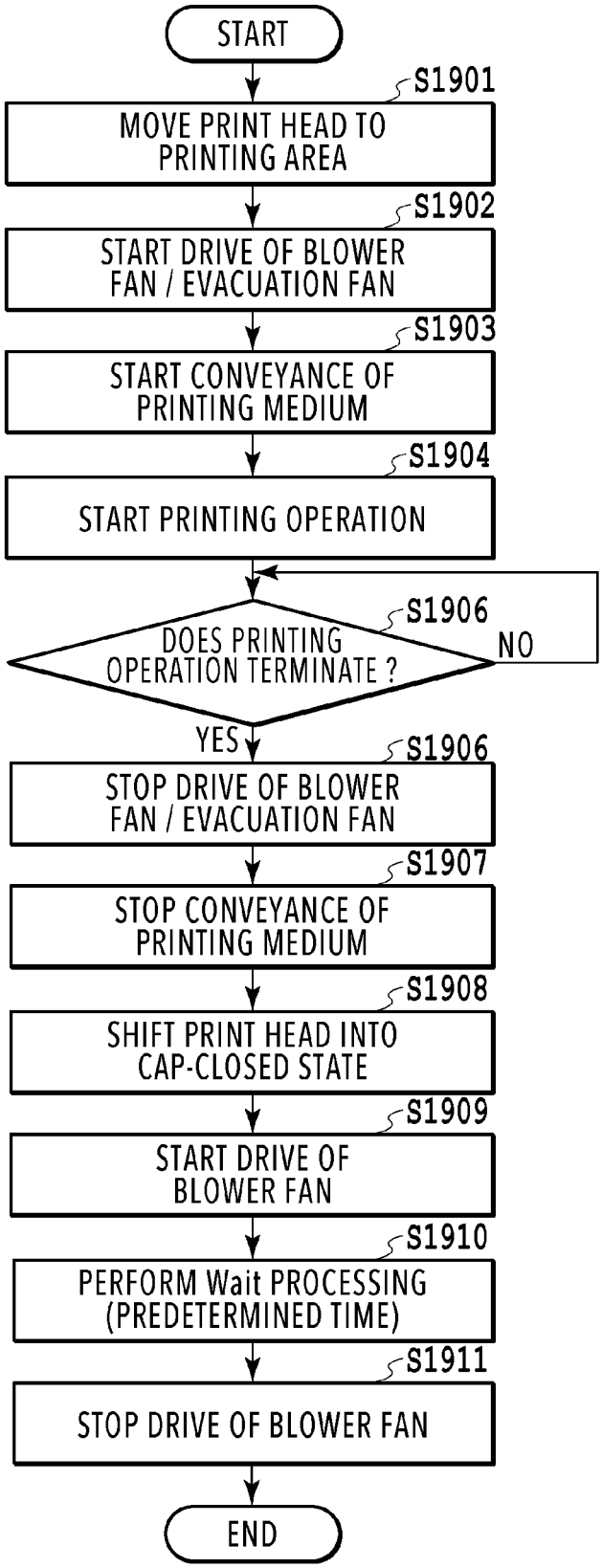
FIG. 19 is a flowchart of the paper powder removal sequence.

Following the above, each piece of processing in the paper powder removal sequence is explained by using FIG. 19.

At step S1901, the print controller 202 moves the print head 8 to the printing area by controlling the head carriage control unit 208. In the following, "step S-" is simply abbreviated to "S-".

At S1902, the print controller 202 starts the drive of each of the blower fan 91 and the evacuation fan 94 at a predetermined drive strength. The drive strength of the blower fan 91 and the evacuation fan 94 at this step may be or may not be the same. For example, in order to efficiently discharge the mist generated in the printing operation to the outside of the apparatus, it may also be possible to set the drive strength of the evacuation fan 94 greater than the drive strength of the blower fan 91. By this step, the flow of the air sucked in by the blower fan 91 reaching the printing area by passing through the air sending flow path 92 and the flow of the air in the printing area being discharged to the outside of the printing apparatus 1 from the evacuation port 97 by passing through the evacuation flow path 96 are generated.

At S1903, the print controller 202 starts conveyance of a printing medium by controlling the conveyance control unit.

At S1904, the print controller 202 starts the printing operation based on a print job, specifically, the operation to form an image by driving the printing element 1004 to eject ink to a printing medium.

At S1905, the print controller 202 determines whether the printing operation based on a print job terminates. In a case where determination results at this step are affirmative, the print controller 202 advances the processing to step S1906. On the other hand, in a case where determination results at this step are negative, the print controller 202 waits until the printing operation based on a print job terminates.

At S1906, the print controller 202 stops the drive of each of the blower fan 91 and the evacuation fan 94. The reason the drive of the blower fan 91 and the evacuation fan 94 is stopped at this step is as follows. That is, in a case where it is determined that the printing operation terminates at S1905, ink is no longer ejected from the ejection port 1006 afterward and no mist is generated in the printing area, and therefore, it is no longer necessary to discharge the mist to the outside of the apparatus by driving these fans. However, at this time, the conveyance of a printing medium continues on the downstream side of the printing area in the conveyance direction, and therefore, there is a possibility that paper powder is generated resulting from the conveyance.

At S1907, the print controller 202 stops the conveyance of a printing medium by controlling the conveyance control unit. There is a possibility that the paper powder generated accompanying the conveyance of a printing medium is floating within the conveyance path after this step. In a case where the paper powder is floating, the paper powder sticks to and accumulates in the conveyance path unless some measures are taken.

At S1908, the print controller 202 shifts the print head 8 from the cap-open state into the cap-closed state by controlling the maintenance control unit 210 to move the cap unit 10 so as to cap the ejection port surface 8*a*.

At S1909, the print controller 202 starts (resumes) the drive of the blower fan 91. By this step, the paper powder floating in the conveyance path is sent from the downstream side in the conveyance direction toward the upstream side.

At S1910, the print controller 202 keeps the state where the blower fan 91 is driving, whose drive is started at S1909, for a predetermined time. By the processing at S1909 and S1910, the majority of the paper powder floating within the conveyance path is sent to the printing area. However, at S1908, the ejection port 1006 is protected by shifting the print head 8 into the cap-closed state, and therefore, it is possible to prevent an ejection failure of the ejection port 1006 caused by the paper powder sticking to the ejection port 1006. It may also be possible to discharge the paper powder to the outside of the printing apparatus 1 by driving the evacuation fan 94, in addition to the blower fan 91 at S1909 and S1910. At this time, it is possible to remove the paper powder efficiently by increasing the amount of air discharged to the outside of the apparatus by the evacuation fan 94 more than the amount of air sent by the blower fan 91.

At S1911, the print controller 202 stops the drive of the blower fan 91. The above is the contents of the paper powder removal sequence in the present embodiment.

<About Modification Example of Present Embodiment>

In the embodiments described previously, it is supposed that the blower fan 91 and the evacuation fan 94 are driven at a constant drive strength at all times. However, it may also be possible to change the drive strength of the blower fan 91 or the evacuation fan 94 in accordance with at least one of the size and the conveyance speed in view of that the amount of paper powder floating in the conveyance path is different depending on the size and the conveyance speed of a printing medium. For example, in a case where the size of a printing medium to be conveyed is large and the conveyance speed is high, the amount of paper powder floating within the conveyance path is large, and therefore, it is considered to increase the drive strength of these fans. Conversely, a configuration may be accepted in which in a case where it is estimated that the amount of floating paper powder is small, such as a case where the size of a printing medium to be conveyed is small and a case where the conveyance speed is low, the control at S1909 and S1910 shown in FIG. 19 is not performed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, it is possible to remove paper powder from a conveyance path while preventing the paper powder floating in the conveyance path from sticking to an ejection port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151633, filed Aug. 10, 2018, which is hereby incorporated by reference wherein in its entirety.

What is claimed is:

1. A printing apparatus comprising:

a conveyance unit configured to convey a printing medium along a conveyance path;

a print head having an ejection unit configured to eject a liquid to the printing medium and performing a printing operation to eject the liquid from the ejection unit in a printing area including a part of the conveyance path;

a blower unit configured to blow air from a downstream of the printing area toward the printing area in the conveyance path in a state where the print head performs the printing operation; and a cap member switchable between a cap-closed state where an ejection port surface of the ejection unit is capped and a cap-open state where the ejection port surface is not capped, wherein the blower unit stops to blow air after the printing operation terminates, and the blower unit resumes to blow air after the cap member switches from the cap-open state into the cap-closed state.

2. The printing apparatus according to claim 1, further having:

An air collection unit configured to collect air blown to an upstream side of the conveyance path by the blower unit.

3. The printing apparatus according to claim 2, wherein the air collection unit collects air blown to an upstream side of the conveyance path by the blower unit during the printing operation, after the printing operation terminates, the air collection unit is stopped, and in a case where the blower unit resumes to blow air, the air collection unit also resumes to collect air.

4. The printing apparatus according to claim 2, wherein an amount of air collected by the air collection unit is larger than an amount of air blown by the blower unit.

5. The printing apparatus according to claim 2, wherein the air collection unit collects mist of a liquid ejected from the ejection unit in the printing area.

6. The printing apparatus according to claim 2, wherein the blower unit and the air collection unit are attached to the conveyance unit integrally.

7. The printing apparatus according to claim 6, wherein the blower unit includes a first intake port to take in outside air, a first fan to suck in air via the first intake port, a first flow path through which the sucked-in air flows, and a connection unit configured to connect to the conveyance unit and the air collection unit includes a second intake port to take in air blown to an upstream side of the conveyance path by the blower unit, a second fan to suck in air via the second intake port, a second flow path through which the sucked-in air flows, and an evacuation port to discharge the air to outside of the apparatus.

8. The printing apparatus according to claim 1, wherein intensity of blowing by the blower unit changes in accordance with at least one of a size and a conveyance speed of the printing medium.

9. A control method of a printing apparatus having:

a conveyance unit configured to convey a printing medium along a conveyance path;

a print head having an ejection unit configured to eject a liquid to the printing medium and performing a printing operation to eject the liquid in a printing area including a part of the conveyance path;

a blower unit configured to blow air from a downstream of the printing area toward the printing area in the conveyance path; and a cap member switchable between a cap-closed state where an ejection port surface of the ejection unit is capped and a cap-open state where the ejection port surface is not capped, wherein the control method comprises:

a step of blowing air by the blower unit in a state where the print head performs the printing operation in the printing area;

a step of stopping blowing by the blower unit after the printing operation terminates; and a step of resuming blowing by the blower unit after the cap member switches from the cap-open state into a cap-closed state.

10. The control method according to claim 9, wherein the printing apparatus further has an air collection unit configured to collect air blown to an upstream side of the conveyance path by the blower unit and the control method further has a step of performing air collection by the air collection unit during the printing operation.

11. The control method according to claim 10, further having:

a step of stopping air collection by the air collection unit after the printing operation terminates; and a step of resuming air blowing by the blower unit and air collection by the air collection unit.

12. The control method according to claim 10, wherein an amount of air collected by the air collection unit is larger than an amount of air blown by the blower unit.

13. The control method according to claim 10, wherein the air collection unit collects mist of a liquid ejected from the ejection unit in the printing area.

14. The control method according to claim 10, wherein the blower unit and the air collection unit are attached to the conveyance unit integrally.

15. The control method according to claim 14, wherein the blower unit includes a first intake port to take in outside air, a first fan to suck in air via the first intake port, a first flow path through which the sucked-in air flows, and a connection unit configured to connect to the conveyance unit and the air collection unit includes a second intake port to take in air blown to an upstream side of the conveyance path by the blower unit, a second fan to suck in air via the second intake port, a second flow path through which the sucked-in air flows, and an evacuation port to discharge the air to outside of the apparatus.

16. The control method according to claim 9, wherein intensity of blowing by the blower unit changes in accordance with at least one of a size and a conveyance speed of the printing medium.

17. A non-transitory computer readable storage medium storing a program for causing a computer to perform a control method of a printing apparatus having:

a conveyance unit configured to convey a printing medium along a conveyance path;

a print head having an ejection unit configured to eject a liquid to the printing medium and performing a printing operation to eject the liquid in a printing area including a part of the conveyance path;

a blower unit configured to blow air from a downstream of the printing area toward the printing area in the conveyance path; and a cap member switchable between a cap-closed state where an ejection port surface of the ejection unit is capped and a cap-open state where the ejection port surface is not capped, wherein the control method comprises:

a step of blowing air by the blower unit in a state where the print head performs the printing operation in the printing area;

a step of stopping blowing by the blower unit after the printing operation terminates; and a step of resuming blowing by the blower unit after the cap member switches from the cap-open state into a cap-closed state.

* * * * *